US011616302B2

(12) United States Patent
George et al.

(10) Patent No.: US 11,616,302 B2
(45) Date of Patent: Mar. 28, 2023

(54) DIELECTRIC RESONATOR ANTENNA HAVING FIRST AND SECOND DIELECTRIC PORTIONS

(71) Applicant: Rogers Corporation, Chandler, AZ (US)

(72) Inventors: Roshin Rose George, Burlington, MA (US); Kristi Pance, Auburndale, MA (US)

(73) Assignee: ROGERS CORPORATION, Chandler, AZ (US)

( * ) Notice: Subject to any disclaimer, the term of this patent is extended or adjusted under 35 U.S.C. 154(b) by 486 days.

(21) Appl. No.: 16/246,886

(22) Filed: Jan. 14, 2019

(65) Prior Publication Data

US 2019/0221939 A1 Jul. 18, 2019

Related U.S. Application Data

(60) Provisional application No. 62/693,057, filed on Jul. 2, 2018, provisional application No. 62/633,256, filed on Feb. 21, 2018, provisional application No. 62/617,358, filed on Jan. 15, 2018.

(51) Int. Cl.

| | |
|---|---|
| ***H01Q 9/04*** | (2006.01) |
| ***H01Q 19/18*** | (2006.01) |
| *H01Q 15/08* | (2006.01) |
| *H01P 5/107* | (2006.01) |
| *H01Q 21/06* | (2006.01) |

(52) U.S. Cl.

CPC ..... *H01Q 9/0485* (2013.01); *H01Q 19/18* (2013.01); *H01P 5/107* (2013.01); *H01Q 15/08* (2013.01); *H01Q 21/061* (2013.01)

(58) Field of Classification Search

CPC .... H01Q 9/0485; H01Q 19/18; H01Q 21/061; H01Q 15/08; H01P 5/107

See application file for complete search history.

(56) References Cited

U.S. PATENT DOCUMENTS

| | | | |
|---|---|---|---|
| 2,624,002 | A | 10/1952 | Bouix |
| 3,212,454 | A | 10/1965 | Ringenbach |
| 3,255,453 | A | 6/1966 | Horst |
| 3,321,765 | A | 5/1967 | Peters et al. |
| 3,321,821 | A | 5/1967 | Horst |
| 4,274,097 | A | 6/1981 | Krall et al. |

(Continued)

FOREIGN PATENT DOCUMENTS

| | | |
|---|---|---|
| CN | 102130376 | 7/2011 |
| CN | 102130377 A | 7/2011 |

(Continued)

OTHER PUBLICATIONS

Buerkle, A. et al; "Fabrication of a DRA Array Using Ceramic Stereolithography"; IEEE Antennas and Wireless Popagation Letters; IEEE; vol. 5,, No. 1, Jan. 2007; pp. 479-481.

(Continued)

*Primary Examiner* — Graham P Smith

(74) *Attorney, Agent, or Firm* — Cantor Colburn LLP

(57) ABSTRACT

An electromagnetic device includes: a first electromagnetic, EM, signal feed; a second EM signal feed disposed adjacent to the first EM signal feed; and, an elevated electrically conductive region disposed between and elevated relative to the first and second EM signal feeds.

21 Claims, 28 Drawing Sheets

(56) References Cited

U.S. PATENT DOCUMENTS 4,288,795 A 9/1981 Shelton
4,366,484 A 12/1982 Weiss et al.
4,458,249 A 7/1984 Valentino et al.
4,575,330 A 3/1986 Hull
4,743,915 A 5/1988 Rammos et al.
4,929,402 A 5/1990 Hull
4,983,910 A * 1/1991 Majidi-Ahy ..... G01R 1/06772 333/32
5,061,943 A * 10/1991 Rammos ..... H01Q 1/38 343/789
5,104,592 A 4/1992 Hull et al.
5,125,111 A * 6/1992 Trinh ..... H01P 5/1015 455/328
5,184,307 A 2/1993 Hull et al.
5,192,559 A 3/1993 Hull et al.
5,227,749 A 7/1993 Raguenet et al.
5,234,636 A 8/1993 Hull et al.
5,236,637 A 8/1993 Hull
5,273,691 A 12/1993 Hull et al.
5,453,754 A 9/1995 Fray
5,476,749 A 12/1995 Steinmann et al.
5,589,842 A 12/1996 Wang et al.
5,667,796 A 9/1997 Otten
5,677,796 A 10/1997 Zimmerman et al.
5,828,271 A 10/1998 Stitzer
5,854,608 A 12/1998 Leisten
5,867,120 A 2/1999 Ishikawa et al.
5,940,036 A 8/1999 Oliver et al.
5,943,005 A 8/1999 Tanizaki et al.
5,952,972 A 9/1999 Ittipiboon et al.
6,008,755 A 12/1999 Ishikawa et al.
6,031,433 A 2/2000 Tanizaki et al.
6,052,087 A 4/2000 Ishikawa et al.
6,061,026 A 5/2000 Ochi et al.
6,061,031 A 5/2000 Cosenza et al.
6,075,492 A 6/2000 Schmidt et al.
6,076,324 A 6/2000 Daily et al.
6,133,887 A 10/2000 Tanizaki et al.
6,147,647 A 11/2000 Tassoudji et al.
6,181,297 B1 1/2001 Leisten
6,188,360 B1 2/2001 Kato et al.
6,198,450 B1 3/2001 Adachi et al.
6,268,833 B1 7/2001 Tanizaki et al.
6,292,141 B1 9/2001 Lim
6,314,276 B1 11/2001 Hilgers et al.
6,317,095 B1 11/2001 Teshirogi et al.
6,323,808 B1 11/2001 Heinrichs et al.
6,323,824 B1 11/2001 Heinrichs et al.
6,344,833 B1 2/2002 Lin et al.
6,373,441 B1 4/2002 Porath et al.
6,437,747 B1 8/2002 Stoiljkovic et al.
6,476,774 B1 11/2002 Davidson et al.
6,528,145 B1 3/2003 Berger et al.
6,552,687 B1 4/2003 Rawnick et al.
6,556,169 B1 4/2003 Fukuura et al.
6,621,381 B1 9/2003 Kundu et al.
6,743,744 B1 6/2004 Kim et al.
6,794,324 B1 9/2004 Kim et al.
6,816,118 B2 11/2004 Kingsley et al.
6,816,128 B1 11/2004 Jennings
6,855,478 B2 2/2005 DeVoe et al.
7,161,535 B2 1/2007 Palmer et al.
7,179,844 B2 2/2007 Aki
7,183,975 B2 2/2007 Thomas et al.
7,196,663 B2 3/2007 Bozer et al.
7,253,789 B2 8/2007 Kingsley et al.
7,279,030 B2 10/2007 Kurowski
7,292,204 B1 11/2007 Chang et al.
7,310,031 B2 12/2007 Pance et al.
7,355,560 B2 4/2008 Nagai
7,379,030 B1 5/2008 Lier
7,382,322 B1 6/2008 Yang et al.
7,443,363 B2 10/2008 Ying
7,498,969 B1 3/2009 Paulsen et al.
7,534,844 B2 5/2009 Lee et al.
7,545,327 B2 6/2009 Iellici et al.
7,550,246 B2 6/2009 Fukuzumi et al.
7,570,219 B1 8/2009 Paulsen et al.
7,595,765 B1 9/2009 Hirsch et al.
7,636,063 B2 12/2009 Channabasappa
7,649,029 B2 1/2010 Kolb et al.
7,663,553 B2 2/2010 Chang et al.
7,688,263 B1 3/2010 Oxley
7,710,325 B2 5/2010 Cheng
7,767,728 B2 8/2010 Lu et al.
7,796,080 B1 9/2010 Lynch et al.
7,824,839 B2 11/2010 Ober et al.
7,835,600 B1 11/2010 Yap et al.
7,935,476 B2 5/2011 Teng
7,961,148 B2 6/2011 Goldberger
8,018,397 B2 9/2011 Jow et al.
8,098,187 B1 1/2012 Lynch et al.
8,098,197 B1 1/2012 Herting et al.
8,119,214 B2 2/2012 Schwantes et al.
8,232,043 B2 7/2012 Williamson et al.
8,498,539 B1 7/2013 Iichenko et al.
8,736,502 B1 5/2014 Langfield et al.
8,773,319 B1 7/2014 Anderson et al.
8,902,115 B1 12/2014 Loui et al.
9,112,273 B2 8/2015 Christie et al.
9,184,697 B2 11/2015 Sekiguchi et al.
9,205,601 B2 12/2015 Desimone et al.
9,225,070 B1 12/2015 Zeweri et al.
9,583,837 B2 * 2/2017 Xue ..... H01Q 9/0407
9,608,330 B2 3/2017 Singleton et al.
9,825,373 B1 11/2017 Smith
9,930,668 B2 3/2018 Barzegar et al.
10,355,361 B2 7/2019 Pance et al.
10,476,164 B2 11/2019 Pance et al.
10,522,917 B2 12/2019 Pance et al.
10,587,039 B2 3/2020 Pance et al.
10,601,137 B2 3/2020 Pance et al.
10,700,438 B2 6/2020 Gerding
11,108,159 B2 8/2021 Pance et al.
2001/0013842 A1 8/2001 Ishikawa et al.
2001/0043158 A1 11/2001 Adachi et al.
2002/0000947 A1 1/2002 Al-Rawi et al.
2002/0057138 A1 5/2002 Takagi et al.
2002/0067317 A1 6/2002 Sakurada
2002/0149108 A1 * 10/2002 Ahn ..... H01L 23/66 438/626
2002/0180646 A1 12/2002 Kivekas et al.
2002/0196190 A1 12/2002 Lim
2003/0016176 A1 1/2003 Kingsley et al.
2003/0034922 A1 2/2003 Isaacs et al.
2003/0043075 A1 3/2003 Bit-Babik et al.
2003/0043086 A1 3/2003 Schaffner et al.
2003/0122729 A1 7/2003 Diaz et al.
2003/0151548 A1 8/2003 Kingsley et al.
2003/0181312 A1 9/2003 Mailadil et al.
2004/0029709 A1 2/2004 Oba et al.
2004/0029985 A1 2/2004 Aki et al.
2004/0036148 A1 2/2004 Block et al.
2004/0051602 A1 3/2004 Pance et al.
2004/0080455 A1 4/2004 Lee
2004/0113843 A1 6/2004 Le Bolzer et al.
2004/0119646 A1 6/2004 Ohno et al.
2004/0127248 A1 7/2004 Lin et al.
2004/0130489 A1 7/2004 Le Bolzer et al.
2004/0155817 A1 8/2004 Kingsley et al.
2004/0233107 A1 11/2004 Popov et al.
2004/0257176 A1 12/2004 Pance et al.
2004/0263422 A1 12/2004 Lynch
2005/0017903 A1 1/2005 Ittipiboon et al.
2005/0024271 A1 2/2005 Ying et al.
2005/0057402 A1 3/2005 Ohno et al.
2005/0099348 A1 5/2005 Pendry
2005/0122273 A1 6/2005 Legay et al.
2005/0154567 A1 7/2005 Jackman et al.
2005/0162316 A1 7/2005 Thomas et al.
2005/0162733 A1 7/2005 Cho et al.
2005/0179598 A1 8/2005 Legay et al.
2005/0200531 A1 9/2005 Huang et al.
2005/0219130 A1 10/2005 Koch et al.

(56) References Cited

U.S. PATENT DOCUMENTS

2005/0225499 A1 10/2005 Kingsley et al.
2005/0242996 A1 11/2005 Palmer et al.
2005/0248421 A1* 11/2005 Joodaki ..... H01P 11/003 333/238
2005/0264449 A1 12/2005 Strickland
2005/0264451 A1 12/2005 Aikawa et al.
2005/0264452 A1 12/2005 Fujishima et al.
2006/0022875 A1 2/2006 Pidwerbetsky et al.
2006/0119518 A1 6/2006 Ohmi et al.
2006/0145705 A1 7/2006 Raja
2006/0194690 A1 8/2006 Osuzu
2006/0220958 A1 10/2006 Saegrov
2006/0232474 A1 10/2006 Fox
2006/0293651 A1 12/2006 Cronin
2007/0067058 A1 3/2007 Miyamoto et al.
2007/0152884 A1 7/2007 Bouche et al.
2007/0164420 A1 7/2007 Chen et al.
2007/0252778 A1 11/2007 Ide et al.
2008/0036675 A1 2/2008 Fujieda
2008/0042903 A1 2/2008 Cheng
2008/0048915 A1 2/2008 Chang et al.
2008/0079182 A1 4/2008 Thompson et al.
2008/0094309 A1 4/2008 Pance et al.
2008/0122703 A1 5/2008 Ying
2008/0129616 A1 6/2008 Li et al.
2008/0129617 A1 6/2008 Li et al.
2008/0019195 A1 8/2008 Tokoro et al.
2008/0193749 A1 8/2008 Thompson et al.
2008/0202720 A1* 8/2008 Wagstaff ..... B22D 11/007 164/127
2008/0260323 A1 10/2008 Jalali et al.
2008/0272963 A1 11/2008 Chang et al.
2008/0278378 A1 11/2008 Chang et al.
2009/0040131 A1 2/2009 Mosallaei
2009/0073332 A1 3/2009 Irie
2009/0102739 A1 4/2009 Chang et al.
2009/0128262 A1 5/2009 Lee et al.
2009/0128434 A1 5/2009 Chang et al.
2009/0140944 A1 6/2009 Chang et al.
2009/0153403 A1 6/2009 Chang et al.
2009/0179810 A1 7/2009 Kato et al.
2009/0184875 A1 7/2009 Chang et al.
2009/0206957 A1 8/2009 Hiroshima et al.
2009/0262022 A1 10/2009 Ying
2009/0270244 A1 10/2009 Chen et al.
2009/0305652 A1 12/2009 Boffa et al.
2010/0002312 A1 1/2010 Duparre et al.
2010/0051340 A1 3/2010 Yang et al.
2010/0103052 A1 4/2010 Ying
2010/0156754 A1 6/2010 Kondou
2010/0220024 A1 9/2010 Snow et al.
2010/0231452 A1 9/2010 Babakhani et al.
2011/0012807 A1 1/2011 Sorvala
2011/0050367 A1 3/2011 Yen et al.
2011/0121258 A1 5/2011 Hanein et al.
2011/0122036 A1 5/2011 Leung et al.
2011/0133991 A1 6/2011 Lee et al.
2011/0204531 A1 8/2011 Hara et al.
2011/0248890 A1 10/2011 Lee et al.
2012/0045619 A1 2/2012 Ando et al.
2012/0092219 A1 4/2012 Kim
2012/0212386 A1 8/2012 Massie et al.
2012/0242553 A1 9/2012 Leung et al.
2012/0245016 A1 9/2012 Curry et al.
2012/0256796 A1 10/2012 Leiba
2012/0274523 A1 11/2012 Ayatollahi
2012/0276311 A1 11/2012 Chirila
2012/0280380 A1 11/2012 Kamgaing
2012/0287008 A1 11/2012 Kim
2012/0306713 A1 12/2012 Raj et al.
2012/0329635 A1 12/2012 Hill
2013/0076570 A1 3/2013 Lee et al.
2013/0088396 A1 4/2013 Han
2013/0113674 A1 5/2013 Ryu
2013/0120193 A1 5/2013 Hoppe et al.
2013/0127669 A1* 5/2013 Han ..... H01Q 9/0485 343/700 MS
2013/0234898 A1 9/2013 Leung et al.
2013/0278610 A1 10/2013 Stephanou et al.
2014/0043189 A1 2/2014 Lee et al.
2014/0091103 A1 4/2014 Neitzel
2014/0139370 A1 5/2014 Hammer et al.
2014/0327591 A1 11/2014 Kokkinos
2014/0327597 A1 11/2014 Rashidian et al.
2015/0035714 A1* 2/2015 Zhou ..... H01Q 3/26 343/767
2015/0070230 A1 3/2015 Bradley et al.
2015/0077198 A1 3/2015 Yatabe
2015/0138036 A1 4/2015 Harper
2015/0183167 A1 7/2015 Molinari et al.
2015/0207233 A1 7/2015 Kim et al.
2015/0207234 A1 7/2015 Ganchrow et al.
2015/0236428 A1 8/2015 Caratelli et al.
2015/0244082 A1 8/2015 Caratelli et al.
2015/0266244 A1 9/2015 Page
2015/0303546 A1 10/2015 Rashidian et al.
2015/0314526 A1 11/2015 Cohen
2015/0346334 A1 12/2015 Nagaishi et al.
2015/0380824 A1 12/2015 Tayfeh Aligodarz et al.
2016/0036132 A1 2/2016 Rumpf et al.
2016/0107290 A1 4/2016 Bajaj et al.
2016/0111769 A1 4/2016 Pance et al.
2016/0218437 A1 7/2016 Guntupalli et al.
2016/0219976 A1 8/2016 Guyan
2016/0263823 A1 9/2016 Espiau et al.
2016/0294066 A1 10/2016 Djerafi et al.
2016/0294068 A1 10/2016 Djerafi et al.
2016/0313306 A1 10/2016 Ingber et al.
2016/0314431 A1 10/2016 Quezada
2016/0322708 A1 11/2016 Tayfeh Aligodarz et al.
2016/0351996 A1 12/2016 Ou
2016/0372955 A1 12/2016 Fackelmeier et al.
2017/0018851 A1 1/2017 Henry et al.
2017/0040700 A1 2/2017 Leung et al.
2017/0062944 A1 3/2017 Zimmerman et al.
2017/0110804 A1 4/2017 Henry et al.
2017/0125901 A1 5/2017 Sharawi et al.
2017/0125908 A1 5/2017 Pance et al.
2017/0125909 A1 5/2017 Pance et al.
2017/0125910 A1 5/2017 Pance et al.
2017/0179569 A1 6/2017 Kim et al.
2017/0188874 A1 7/2017 Suhami
2017/0201026 A1 7/2017 Werner et al.
2017/0225395 A1 8/2017 Boydston et al.
2017/0256847 A1 9/2017 Vollmer et al.
2017/0271772 A1 9/2017 Miraftab et al.
2017/0272149 A1 9/2017 Michaels
2017/0324171 A1 11/2017 Shehan
2017/0360534 A1 12/2017 Sun
2018/0007746 A1 1/2018 Smith
2018/0054234 A1 2/2018 Stuckman et al.
2018/0069594 A1 3/2018 Henry et al.
2018/0090815 A1 3/2018 Shirinfar et al.
2018/0115072 A1 4/2018 Pance et al.
2018/0166789 A1 6/2018 Galla et al.
2018/0183150 A1 6/2018 Sienkiewicz et al.
2018/0241129 A1 8/2018 Pance et al.
2018/0282550 A1 10/2018 Burgess et al.
2018/0309202 A1 10/2018 Pance et al.
2018/0323514 A1 11/2018 Pance et al.
2019/0020105 A1 1/2019 Pance et al.
2019/0115668 A1 4/2019 Coward et al.
2019/0128624 A1 5/2019 Cohen et al.
2019/0214732 A1 7/2019 Leung et al.
2019/0221939 A1 7/2019 George et al.
2019/0221940 A1 7/2019 Pance et al.
2019/0288360 A1* 9/2019 Hendry ..... H01Q 13/06
2019/0319357 A1 10/2019 Pance et al.
2019/0319358 A1 10/2019 Pance et al.
2019/0379123 A1 12/2019 Leung et al.
2019/0393607 A1 12/2019 Pance et al.
2020/0083602 A1 3/2020 Sethumadhavan et al.
2020/0083609 A1 3/2020 Pance et al.
2020/0083610 A1 3/2020 Pance et al.

(56) References Cited

U.S. PATENT DOCUMENTS

| | | | |
|---|---|---|---|
| 2020/0099136 | A1 | 3/2020 | Pance et al. |
| 2020/0122387 | A1 | 4/2020 | Polidore et al. |
| 2020/0194881 | A1 | 6/2020 | Pance et al. |
| 2020/0227827 | A1 | 7/2020 | Vollmer et al. |
| 2021/0328356 | A1 | 10/2021 | Polidore et al. |

FOREIGN PATENT DOCUMENTS

| | | | |
|---|---|---|---|
| CN | 104037505 | A | 9/2014 |
| CN | 105390809 | A | 3/2016 |
| CN | 105490005 | A | 4/2016 |
| CN | 106299672 | A | 1/2017 |
| CN | 107240782 | A | 10/2017 |
| CN | 110212310 | A | 9/2019 |
| CN | 110380230 | A | 10/2019 |
| CN | 216288983 | U | 4/2022 |
| EP | 0468413 | A2 | 1/1992 |
| EP | 0587247 | A1 | 3/1994 |
| EP | 0801436 | A2 | 10/1997 |
| EP | 1772748 | A1 | 4/2007 |
| EP | 1783516 | A1 | 5/2007 |
| EP | 2905632 | A1 | 8/2015 |
| GB | 2050231 | A | 1/1981 |
| GB | 2575946 | A | 1/2020 |
| JP | H0665334 | A | 3/1994 |
| JP | H07154114 | A | 6/1995 |
| JP | 08191211 | A | 7/1996 |
| JP | 2004112131 | A | 4/2004 |
| JP | 2013211841 | A | 10/2010 |
| RU | 2660385 | | 7/2018 |
| WO | 9513565 | A1 | 5/1995 |
| WO | 0076028 | A1 | 12/2000 |
| WO | 2012129968 | A1 | 10/2012 |
| WO | 2014100462 | A1 | 6/2014 |
| WO | 2014126837 | A2 | 8/2014 |
| WO | 2015102938 | A1 | 7/2015 |
| WO | 2016153711 | A1 | 9/2016 |
| WO | 2017040883 | A1 | 3/2017 |
| WO | 2017075177 | A1 | 5/2017 |
| WO | 2017075184 | A1 | 5/2017 |
| WO | 2017090401 | A1 | 6/2017 |
| WO | 2018010443 | A1 | 1/2018 |
| WO | 2017075186 | A1 | 5/2018 |
| WO | 2018226657 | A1 | 12/2018 |

OTHER PUBLICATIONS

Guo, Yomg-Xin, et al.,; "Wide-Band Stacked Double Annular-Ring Dielectric Resonator Antenna at the End-Fire Mode Operation"; IEEE Transacions on Antennas and Propagation; vol. 53; No. 10; Oct. 2005; 3394-3397 pages.

Kakade, A.B., et al; "Analysis of the Rectangular Waveguide Slot Coupled Multilayer hemispherical Dielectric Resonator Antenna"; IET Microwaves, Antennas & Propagation, The Institution of Engineering and Technology; vol. 6; No. 3; Jul. 11, 2011; 338-347 pages.

Kakade, Anandrao, et al.; Mode Excitation in the Coaxial Probe Coupled Three-Layer Hemispherical Dielectric Resonator Antenna; IEEE Transactions on Antennas and Propagation; vol. 59; No. 12; Dec. 2011; 7 pages.

Kishk, A. Ahmed, et al.,; "Analysis of Dielectric-Resonator with Emphasis on Hemispherical Structures"; IEEE Antennas & Propagation Magazine; vol. 36; No. 2; Apr. 1994; 20-31 pages.

Notification of Transmittal of the International Search Report and the Written Opinion of the International Searching Authority, or the Declaration for International Application No. PCT/US2019/013579; Report dated Mar. 27, 2019; 17 pages.

Petosa, Aldo, et al.; "Dielectric Resonator Antennas: A Historical Review and the Current State of the Art"; IEEE Antennas and Propagation Magazine; vol. 52, No. 5, Oct. 2010; 91-116 pages.

Ruan, Yu-Feng, et al; "Antenna Effects Consideration for Space-Time Coding UWB-Impulse Radio System in IEEE 802.15 Multipath Channel"; Wireless Communications, Networking and Mobile Computing; 2006; 1-4 pages.

Wong, Kin-Lu, et al.,; "Analysis of a Hemispherical Dielectric Resonator Antenna with an Airgap"; IEEE Microwave and Guided Wave Letters; vol. 3; No. 9; Oct. 3, 1993; 355-357 pages.

Zainud-Deen, S H et al; "Dielectric Resonator Antenna Phased Array for Fixed RFID Reader in Near Field Region"; IEEE; Mar. 6, 2012; pp. 102-107.

Raghvendra Kumar Chaudhary et al; Variation of Permittivity in Radial Direction in Concentric Half-Split Cylindrical Dielectric Resonator Antenna for Wideband Application: Permittivity Variation in R-Dir. in CDRA; International Journal of RF and Microwave Computer-Aided Engineering; vol. 25; No. 4; May 1, 2015; pp. 321-329.

Zhang Shiyu et al.; "3D-Printed Graded Index Lenses for RF Applications"; ISAP 2016 International Symposium on Antennas and Propagation, Okinawa, Japan.; pp. 1-27.

Zainud-Deen SH Et al: High Directive Dielectric resonator antenna over curved ground plane using metamaterials, National Radio Science Conference IEEE, Apr. 26, 2011 pp. 1-9.

"New 3D Printed Electromagnetic Lense from OmniPreSense"; URL: http://www.microwavejournal.com/articles/31133-new-3d-printed-electromagnetic-lens-from-omnipresense; Date of Access: Oct. 16, 2018; 8 pages.

"Photoacid Generator Selection Guide for the electronics industry and energy curable coatings" (BASF 2010).

Atabak Rashidian et al; "Photoresist-Based Polymer Resonator Antennas: Lithography Fabrication, Strip-Fed Excitation, and Multimode Operation", IEEE Antennas and Propagation Magazine, IEEE Service Center; vol. 53, No. 4, Aug. 1, 2011; 16-27 pages.

Boriskin et al. "Integrated Lens Antennas" In: "Aperture Antennas for Millimeter and Sub-Millimeter Wave Applications", Sep. 8, 2017, International Publishing, pp. 3-36.

Elboushi A. et al., "High Gain Hybrid DRA/Horn antenna for MMW Applications", Concordia Universitiy; 2014 IEEE; 2 pages.

Hesselbarth et al., "Millimeter-wave front-end integration concept using beam-switched lens antenna", 2016 10th European Conference on Antennas and Propagation, European Assoc. of Antennas and Propagation, Apr. 10, 2016; pp. 1-5.

Keysight Technologies; "Split Post Dielectric Resonators for Dielectric Measurements of Substrates"; Keysight Technologies, Dec. 2, 2017; 5989-5384EN, pp. 1-11.

Krupka et al.; "Split post dielectric resonator technique for precise measurements of laminar dielectric specimens—Measurement uncertainties"; IEEE Xplore Conference Paper Feb. 2000, pp. 305-308.

Krupka J., Gregory A.P., Rochard O.C., Clarke R.N., Riddle B., Baker-Jarvis J., Uncertainty of Complex Permittivity Measurement by Split-Post Dielectric Resonator Techniques, Journal of the European Ceramic Society, No. 10, pp. 2673-2676, 2001.

Krupka, J., Geyer, R.G., Baker-Jarvis, J., Ceremuga, J., Measurements of the complex permittivity of microwave circuit board substrates using split dielectric resonator and reentrant cavity tech¬niques, Seventh International Conference on Dielectric Materials, Measurements and Applications, (Conf. Publ. No. 430), pp. 21-24, Sep. 1996.

Lei, Juan et al., "Experimental demonstration of conformal phased array antenna via transformation optics," Scientific Reports, vol. 8, No. 1, Feb. 28, 2018, 14 pages.

Liang, M. et al.; "A 3-D Luneburg lens antenna fabricated by polymer jetting rapid prototyping," IEEE Transactions on Antennas and Propagation, 62(4), Apr. 2014, 1799-1807.

Tang, W. et al., "Discrete Coordinate Transformation for Designing All-Dielectric Flat Antennas", IEEE Transactions on Antennas and Propagation, vol. 58, No. 12, Dec. 2010 pp. 3795-3804.

Thornton et al., "Introduction" In: "Modern Lens Antennas for Communications Engineering", Jan. 1, 2013 John Wiley & Sons, Inc. pp. 1-48.

Akbari, el al., "Comparison between Circularly-Polarized Hybrid DR/Conical Horn and Hybrid DR /spherical Lens Antennas in Millimeter Wave" 2016 IEEE 5th Asia-Pacific Conference on Antennas and Propagation (pp. 261-262).

* cited by examiner

| Name | X | Y |
|---|---|---|
| m1 | 69.0000 | -8.1631 |
| m2 | 85.0000 | -9.7917 |
| m3 | 79.0000 | -24.0437 |
| m4 | 79.0000 | 12.2670 |

DIELECTRIC RESONATOR ANTENNA HAVING FIRST AND SECOND DIELECTRIC PORTIONS

CROSS REFERENCE TO RELATED APPLICATIONS

This application claims the benefit of U.S. Provisional Application Ser. No. 62/693,057, filed Jul. 2, 2018, which is incorporated herein by reference in its entirety. This application also claims the benefit of U.S. Provisional Application Ser. No. 62/633,256, filed Feb. 21, 2018, which is incorporated herein by reference in its entirety. This application also claims the benefit of U.S. Provisional Application Ser. No. 62/617,358, filed Jan. 15, 2018, which is incorporated herein by reference in its entirety.

BACKGROUND OF THE INVENTION

The present disclosure relates generally to an electromagnetic device, particularly to a dielectric resonator antenna (DRA) system, and more particularly to a DRA system having first and second dielectric portions for enhancing the gain, return loss and isolation associated with a plurality of dielectric structures within the DRA system.

While existing DRA resonators and arrays may be suitable for their intended purpose, the art of DRAs would be advanced with an improved DRA structure for building a high gain DRA system with high directionality in the far field that can overcome existing drawbacks, such as limited bandwidth, limited efficiency, limited gain, limited directionality, or complex fabrication techniques, for example.

BRIEF DESCRIPTION OF THE INVENTION

An embodiment includes an electromagnetic device, having: a first electromagnetic, EM, signal feed; a second EM signal feed disposed adjacent to the first EM signal feed; and, an elevated electrically conductive region disposed between and elevated relative to the first and second EM signal feeds.

The above features and advantages and other features and advantages of the invention are readily apparent from the following detailed description of the invention when taken in connection with the accompanying drawings.

BRIEF DESCRIPTION OF THE DRAWINGS

Referring to the exemplary non-limiting drawings wherein like elements are numbered alike in the accompanying Figures.

DETAILED DESCRIPTION OF THE INVENTION

Although the following detailed description contains many specifics for the purposes of illustration, anyone of ordinary skill in the art will appreciate that many variations and alterations to the following details are within the scope of the claims. Accordingly, the following example embodiments are set forth without any loss of generality to, and without imposing limitations upon, the claimed invention.

An embodiment, as shown and described by the various figures and accompanying text, provides an electromagnetic device in the form of a dielectric structure having a first dielectric portion and a second dielectric portion strategically disposed with respect to the first dielectric portion so as to provide for improved gain, improved bandwidth, improved return loss, and/or improved isolation, when at least the first dielectric portion is electromagnetically excited to radiate (e.g., electromagnetically resonate and radiate) an electromagnetic field in the far field. In an embodiment, only the first dielectric portion is electromagnetically excited to radiate an electromagnetic field in the far field. In another embodiment, both the first dielectric portion and the second dielectric portion are electromagnetically excited to radiate an electromagnetic field in the far field. In an embodiment where only the first dielectric portion is electromagnetically excited to radiate an electromagnetic field in the far field, the first dielectric portion may be viewed as an electromagnetic dielectric resonator, and the second dielectric portion may be viewed as a dielectric electromagnetic beam shaper. In an embodiment where both the first dielectric portion and the second dielectric portion are electromagnetically excited to radiate an electromagnetic field in the far field, the combination of the first dielectric portion and the second dielectric portion may be viewed as an electromagnetic dielectric resonator, and where the second dielectric portion may also be viewed as a dielectric electromagnetic beam shaper. In an embodiment, the dielectric structure is an all-dielectric structure (absent embedded metal or metal particles, for example).

Figure 1A:
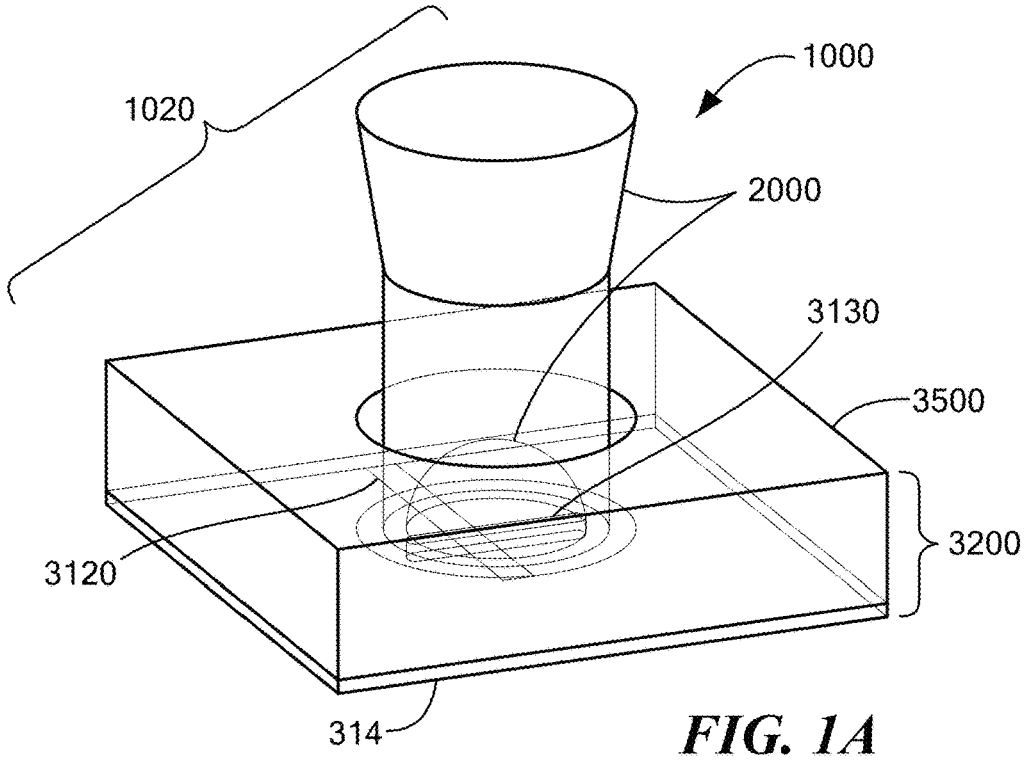
FIG. 1A depicts a rotated perspective view of a unit cell of an electromagnetic, EM, device, in accordance with an embodiment.
Figure 1B:
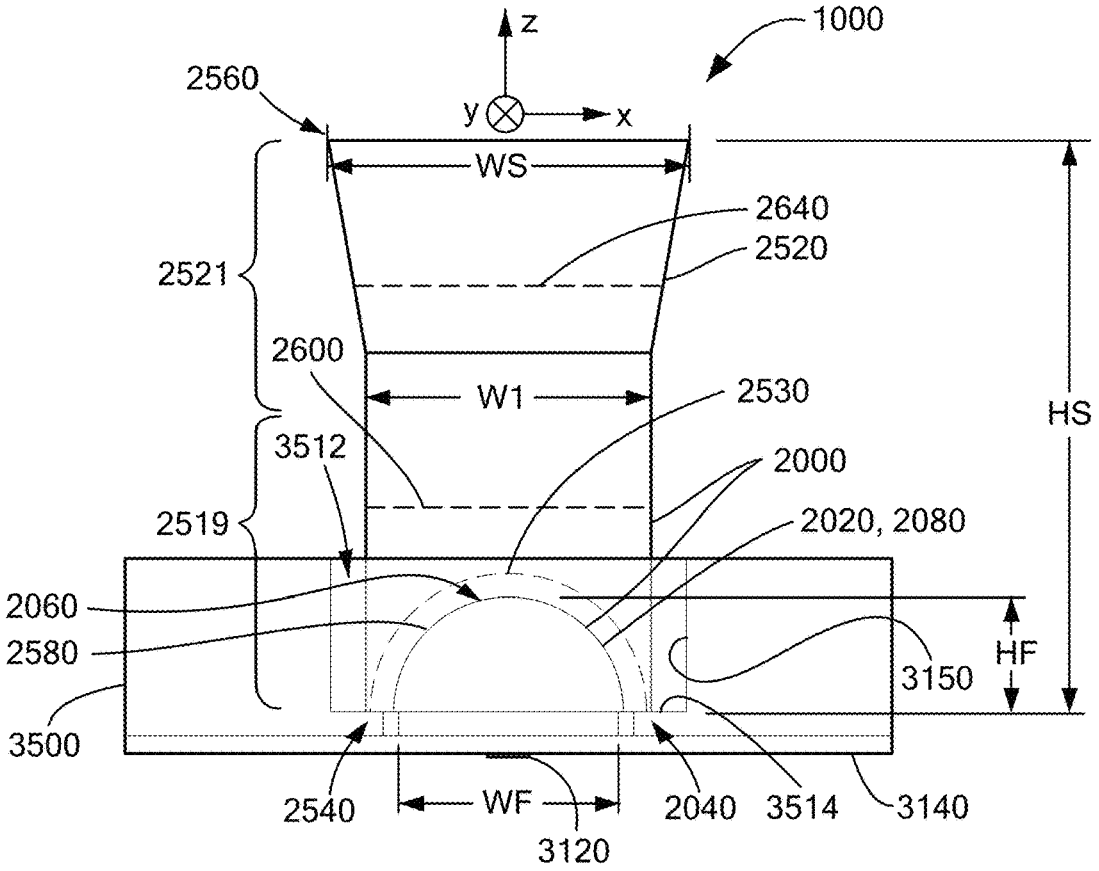
FIG. 1B depicts a side view of the unit cell of FIG. 1A, in accordance with an embodiment.

FIGS. 1A and 1B depict an electromagnetic, EM, device 1000 having a dielectric structure 2000 composed of a first dielectric portion 2020 and a second dielectric portion 2520. The first dielectric portion 2020 has a proximal end 2040 and a distal end 2060, and a three-dimensional, 3D, shape 2080 having a direction of protuberance from the proximal end 2040 to the distal end 2060 oriented parallel with a z-axis of an orthogonal x, y, z coordinate system. For purposes disclosed herein, the z-axis of the orthogonal x, y, z coordinate system is aligned with and is coincidental with a central vertical axis of an associated first dielectric portion 2020, with the x-z, y-z and x-y planes being oriented as depicted in the various figures, and with the z-axis orthogonal to a substrate of the EM device 1000. That said, it will be appreciated that a rotationally translated orthogonal x', y', z' coordinate system may be employed, where the z'-axis is not orthogonal to a substrate of the EM device 1000. Any and all such orthogonal coordinate systems suitable for a purpose disclosed herein are contemplated and considered fall within the scope of an invention disclosed herein. The first dielectric portion 2020 comprises a dielectric material, Dk material, that is other than air, but in an embodiment may include an internal region of air, vacuum, or other gas suitable for a purpose disclosed herein, when the first dielectric portion 2020 is hollow. In an embodiment, the first dielectric portion 2020 has a 3D shape in the form of a hemispherical dome, or in the form of an elongated dome with vertical side walls and a dome shaped top or distal end 2060, or generally in the form having a convex distal end 2060. In an embodiment, the first dielectric portion 2020 may comprise a layered arrangement of dielectric shells to form the hemispherical dome, with each successive outwardly disposed layer substantially embedding and being in direct contact with an adjacent inwardly disposed layer. The second dielectric portion 2520 has a proximal end 2540 and a distal end 2560, with the proximal end 2540 of the second dielectric portion 2520 being disposed proximate the distal end 2060 of the first dielectric portion 2020 to form the dielectric structure 2000. The second dielectric portion 2520 comprises a dielectric material other than air. The second dielectric portion 2520 has a 3D shape having a first x-y plane cross-section area 2580 proximate the proximal end 2540 of the second dielectric portion 2520, and a second x-y plane cross-section area 2600 between the proximal end 2540 and the distal end 2560 of the second dielectric portion 2520, where the second x-y plane cross section area 2600 is greater than the first x-y plane cross-section area 2580. In an embodiment, the first x-y plane cross-section area 2580 and the second x-y plane cross-section area 2600 are circular, but in some other embodiments may be ovaloid, or any other shape suitable for a purpose disclosed herein. In an embodiment, the second dielectric portion 2520 has a third x-y plane cross-section area 2640 disposed between the second x-y plane cross-section area 2600 and the distal end 2560, where the third x-y plane cross-section area 2640 is greater than the second x-y plane cross-section area 2600. In an embodiment, the distal end 2560 of the second dielectric portion 2520 has is planar. In an embodiment, the dielectric material of the first dielectric portion 2020 has an average dielectric constant that is greater than the average dielectric constant of the dielectric material of the second dielectric portion 2520. In an embodiment, the dielectric structure 2000 is an all-dielectric structure absent embedded metal or metal particles, for example. In an embodiment, the first dielectric portion 2020 is a single dielectric material.

In an embodiment, the dielectric material of the first dielectric portion 2020 has an average dielectric constant equal to or greater than 10, and the dielectric material of the second dielectric portion 2520 has an average dielectric constant equal to or less than 9. Alternatively, the dielectric the material of the first dielectric portion 2020 has an average dielectric constant equal to or greater than 11, and the dielectric material of the second dielectric portion 2520 has an average dielectric constant equal to or less than 5. Further alternatively, the dielectric material of the first dielectric portion 2020 has an average dielectric constant equal to or greater than 12, and the dielectric material of the second dielectric portion 2520 has an average dielectric constant equal to or less than 3. Further alternatively, the dielectric material of the first dielectric portion 2020 has an average dielectric constant equal to or greater than 10 and equal to or less than 20, and the dielectric material of the second dielectric portion 2520 has an average dielectric constant equal to or greater than 2 and equal to or less than 9. Further alternatively, the dielectric material of the first dielectric portion 2020 has an average dielectric constant equal to or greater than 10 and equal to or less than 15, and the dielectric material of the second dielectric portion 2520 has an average dielectric constant equal to or greater than 2 and equal to or less than 5. Further alternatively, the dielectric material of the second dielectric portion 2520 has an average dielectric constant equal to or greater than air and equal to or less than 9.

In an embodiment, the second dielectric portion 2520 has an overall maximum height, HS, and an overall maximum width, WS, where HS is greater than WS. In an embodiment, HS is equal to or greater than 1.5 times WS. Alternatively in an embodiment, HS is equal to or greater than 2 times WS.

In an embodiment, the first dielectric portion 2020 has an overall maximum height, HF, and an overall maximum width, WF, where HS is greater than HF, and where WS is greater than WF. In an embodiment, HS is greater than 5 times HF, and WS is greater than 1.2 times WF.

In an embodiment, the second dielectric portion 2520 has a first sub-portion 2519 proximate the proximal end 2540, and a second sub-portion 2521 proximate the distal end 2560, where the second x-y plane cross-section area 2600 is contained within the first sub-portion 2519, and the third x-y cross-section area 2640 is contained within the second sub-portion 2521. In an embodiment, the first sub-portion 2519 has a cylindrical 3D shape with diameter W1, and the second sub-portion 2521 has a frustoconical 3D shape with a lower diameter of W1 expanding to an upper diameter of WS, such that WS is greater than W1. In an embodiment, diameter W1 is greater than diameter WF.

Figure 1C:
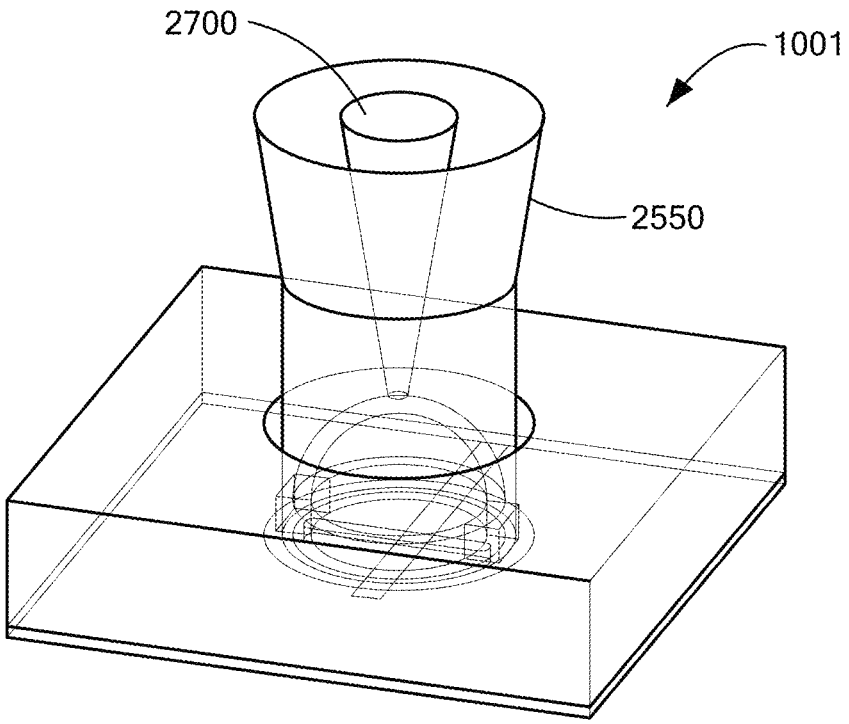
FIG. 1C depicts a rotated perspective view of a unit cell alternative to that depicted in FIG. 1A, in accordance with an embodiment.
Figure 1D:
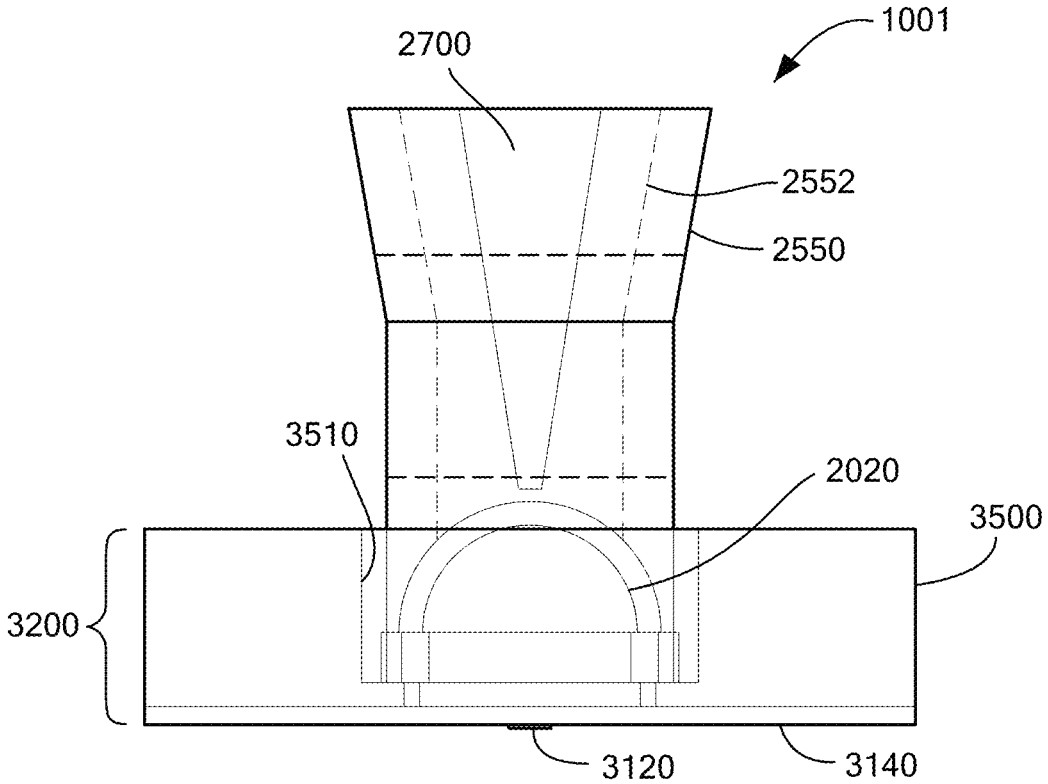
FIG. 1D depicts a side view of the unit cell of FIG. 1C, in accordance with an embodiment.

In an embodiment and with reference now to FIGS. 1C and 1D, an EM device 1001, similar to EM device 1000 where like features are numbered alike, has a second dielectric portion 2550 similar to the second dielectric portion 2520 of FIGS. 1A and 1B, but with an inner region 2700 within the second dielectric portion 2550 that is made from a material having a dielectric constant that is less than the dielectric constant of the remaining outer body portion of the second dielectric portion 2550. In an embodiment, the inner region 2700 is air. Stated generally, the outer body portion of the second dielectric portion 2550 is made from a dielectric material having a first dielectric constant, and the inner region 2700 is made from a dielectric material having a second dielectric constant that is less than the first dielectric constant. Other features of EM device 1001 are similar or identical to those of EM device 1000.

Figure 2:
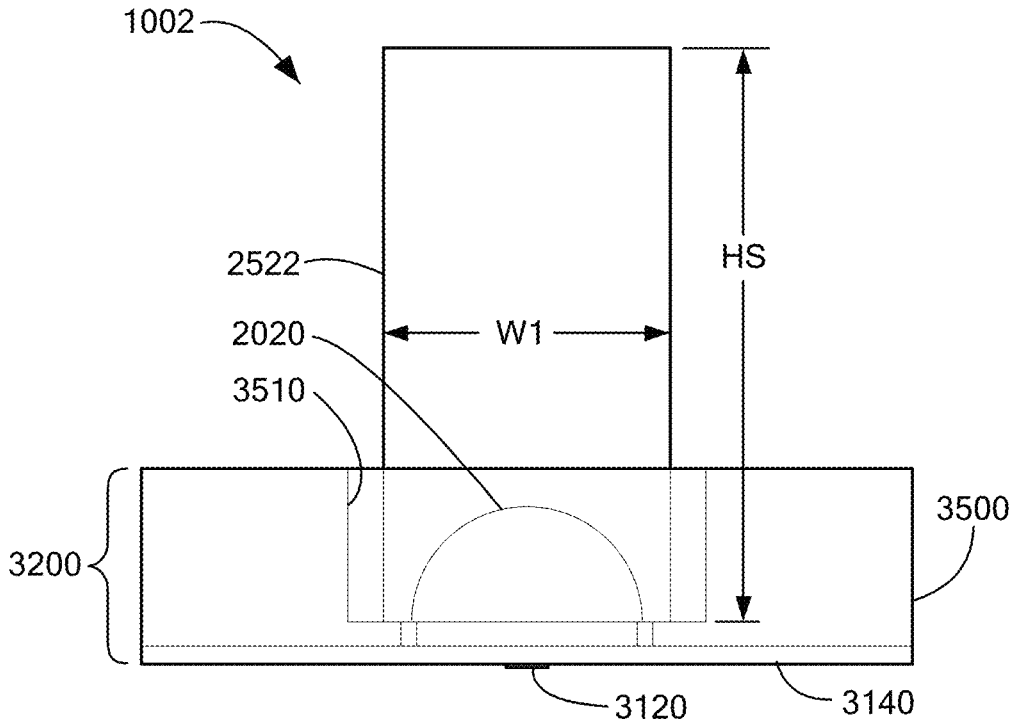
FIG. 2 depicts a side view of a unit cell similar but alternative to that of FIGS. 1B and 1D, in accordance with an embodiment.
Figure 3:
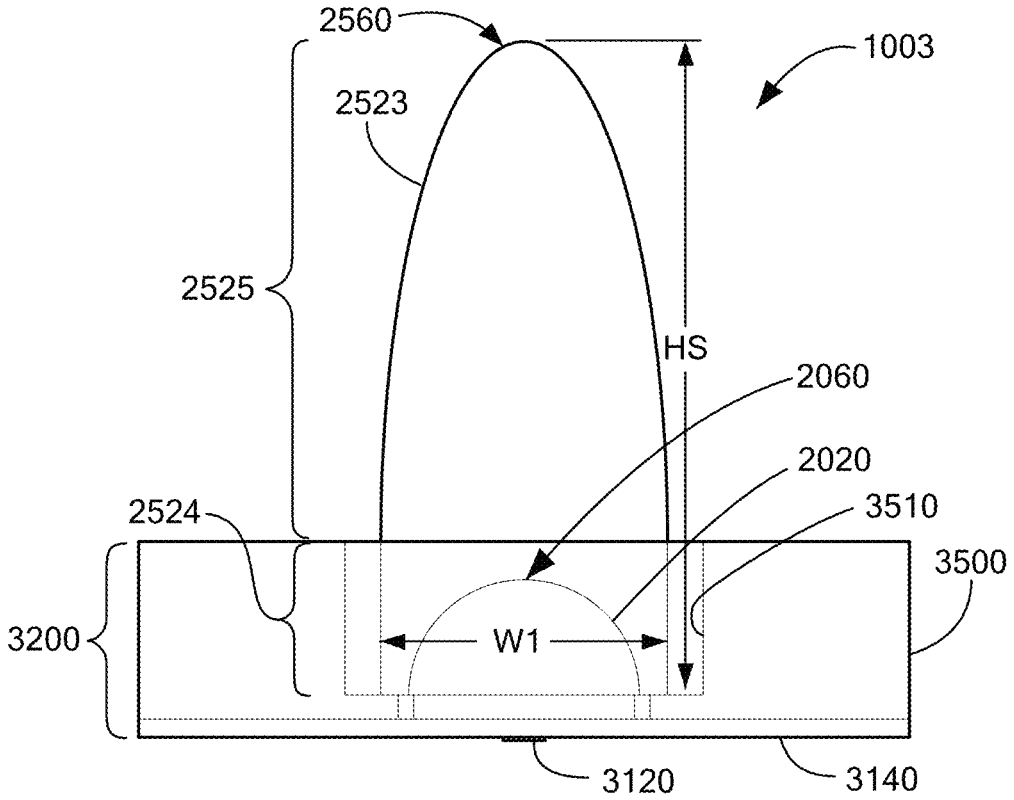
FIG. 3 depicts a side view of a unit cell similar but alternative to that of FIGS. 1B, 1D and 2, in accordance with an embodiment.

Reference is now made to FIGS. 2 and 3, where FIG. 2 depicts an EM device 1002, and FIG. 3 depicts and EM device 1003, and where both EM devices 1002, 1003 are similar to EM device 1000 where like features are numbered alike.

In an embodiment, EM device 1002 depicted in FIG. 2 has a second dielectric portion 2522 similar to the second dielectric portion 2520 of FIGS. 1A and 1B, but with a cylindrical shape having a diameter W1 that extends over the entire height HS of the second dielectric portion 2522. That is, the second dielectric portion 2522 is similar to an extended version of the first sub-portion 2519 of the second dielectric portion 2520 of EM device 1000. In an embodiment, the second dielectric portion 2522 has an overall maximum height, HS, and an overall maximum width, W1, where HS is greater than W1. In an embodiment, HS is equal to or greater than 1.5 times W1. Alternatively in an embodiment, HS is equal to or greater than 2 times W1.

In an embodiment, EM device 1003 depicted in FIG. 3 has a second dielectric portion 2523 having a similar maximum overall width W1 and maximum overall height HS as the second dielectric portion 2522 of EM device 1002, but with a 3D shape a lower portion 2524 with substantially vertical sidewalls, and an upper portion 2525 having a truncated ellipsoidal shape. Comparing FIG. 3 with FIGS. 1A, 1B, 1C, 1D and 2, it can be seen that not only may the first dielectric portion 2020 have a convex distal end 2060, but the second dielectric portion 2523 may also have a convex distal end 2560. In an embodiment, the second dielectric portion 2523 has an overall maximum height, HS, and an overall maximum width, W1, where HS is greater than W1. In an embodiment, HS is equal to or greater than 1.5 times W1. Alternatively in an embodiment, HS is equal to or greater than 2 times W1.

By arranging the height to width ratios of the second dielectric portion 2520, 2521, 2522 as disclosed herein, higher TE (transverse electric) modes are supported, which yields a broader far field TE radiation bandwidth.

In an embodiment, the second dielectric portion 2520, 2521, 2522, 2523 is disposed in direct intimate contact with the first dielectric portion 2020. However, the scope of the invention is not so limited. In an embodiment, the second dielectric portion 2520, 2521, 2522, 2523 is disposed at a distance from the distal end 2060 of the first dielectric portion 2020 that is equal to or less than five times λ, where λ is a freespace wavelength at an operating center frequency of the EM device 1000, depicted by dashed lines 2530 in FIG. 1B. Alternatively, in an embodiment, the second dielectric portion 2520, 2521, 2522, 2523 is disposed at a distance from the distal end 2060 of the first dielectric portion 2020 that is equal to or less than three times λ. Alternatively, in an embodiment, the second dielectric portion 2520, 2521, 2522, 2523 is disposed at a distance from the distal end 2060 of the first dielectric portion 2020 that is equal to or less than two times λ. Alternatively, in an embodiment, the second dielectric portion 2520, 2521, 2522, 2523 is disposed at a distance from the distal end 2060 of the first dielectric portion 2020 that is equal to or less than one times λ. Alternatively, in an embodiment, the second dielectric portion 2520, 2521, 2522, 2523 is disposed at a distance from the distal end 2060 of the first dielectric portion 2020 that is equal to or less than one-half times λ. Alternatively, in an embodiment, the second dielectric portion 2520, 2521, 2522, 2523 is disposed at a distance from the distal end 2060 of the first dielectric portion 2020 that is equal to or less than one-tenth times λ.

Figure 4:
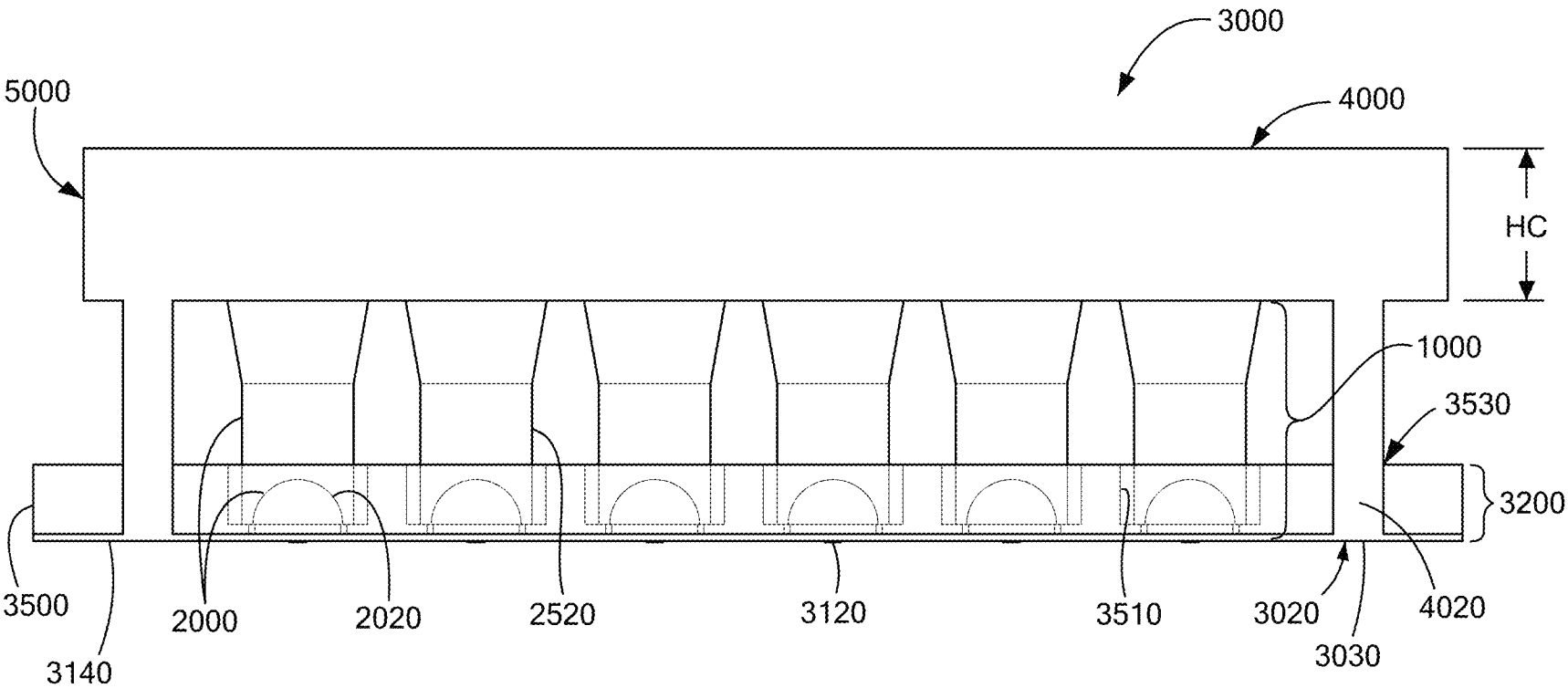
FIG. 4 depicts a side view of an M×N array, where M=6, of a plurality of units cells of FIG. 1B, in accordance with an embodiment.

Reference is now made to FIG. 4, which depicts a plurality of any of the dielectric structures 2000 disclosed herein in an array 3000, where each second dielectric portion 2520, 2521, 2522, 2523 of respective ones of the plurality of dielectric structures 2000 is physically connected to at least one other of the respective second dielectric portions 2520, 2521, 2522, 2523 via a connecting structure 4000. In an embodiment, each connecting structure 4000 is relatively thin (in the plane of the page) as compared to an overall outside dimension, WS or HS for example, of one of the plurality of dielectric structures 2000. In an embodiment, each connecting structure 4000 is formed from a non-gaseous dielectric material, and has a cross sectional overall height HC that is less than an overall height HS of a respective connected dielectric structure 2000. In an embodiment, each connecting structure 4000 and the associated second dielectric portion 2520, 2521, 2522, 2523 forms a single monolithic structure 5000. In an embodiment, each connecting structure 4000 has a cross sectional overall height HC that is less than a free space wavelength λ of a corresponding operating center frequency at which the associated EM device 1000 is operational. In an embodiment, the connecting structure 4000 is formed of a dielectric material that is the same as the dielectric material of the corresponding second dielectric portions 2520, 2521, 2522, 2523. In an embodiment, the connecting structure 4000 and the corresponding second dielectric portions 2520, 2521, 2522, 2523 form the aforementioned single monolithic structure 5000 as a contiguous seamless structure.

With general reference to the aforementioned figures collectively, and with particular reference to FIG. 4, an embodiment of the EM device 1000, 1001, 1002, 1003, or the array 3000 of dielectric structures 2000, further includes a substrate 3200 upon which the individual or the array of dielectric structures 2000 are disposed. In an embodiment, the substrate 3200 includes a dielectric 3140 and a metal fence structure 3500 disposed on the dielectric 3140. With respect to the array 3000 of FIG. 4, the substrate 3200 has at least one support portion 3020, and the connecting structure 4000 has at least one mount portion 4020. In an embodiment, each of the at least one mount portion 4020 is disposed in a one-to-one corresponding relationship with the at least one support portion 3020.

With further general reference to the aforementioned figures collectively, and with particular reference to FIG. 4, an embodiment of the EM device 1000, 1001, 1002, 1003, or the array 3000 of dielectric structures 2000, the metal fence structure 3500 includes a plurality of electrically conductive electromagnetic reflectors 3510 that surround a recess 3512 with an electrically conductive base 3514, each of the plurality of reflectors 3510 being disposed in one-to-one relationship with corresponding ones of the plurality of dielectric structures 2000, and being disposed substantially surrounding each corresponding one of the plurality of dielectric structures 2000. In an embodiment, the metal fence structure 3500 is a unitary metal fence structure, and the plurality of electrically conductive electromagnetic reflectors 3510 are integrally formed with the unitary metal fence structure 3500.

In an embodiment, each respective EM device 1000, 1001, 1002, 1003 includes a signal feed 3120 for electromagnetically exciting a given dielectric structure 2000, where the signal feed 3120 is separated from the metal fence structure 3500 via the dielectric 3140, which in an embodiment is a dielectric medium other than air, and where in an embodiment the signal feed 3120 is a microstrip with slotted aperture 3130 (see FIG. 1A for example). However, excitation of a given dielectric structure 2000 may be provided by any signal feed suitable for a purpose disclosed herein, such as a copper wire, a coaxial cable, a microstrip (e.g., with slotted aperture), a stripline (e.g., with slotted aperture), a waveguide, a surface integrated waveguide, a substrate integrated waveguide, or a conductive ink, for example, that is electromagnetically coupled to the respective dielectric structure 2000. As will be appreciated by one skilled in the art, the phrase electromagnetically coupled is a term of art that refers to an intentional transfer of electromagnetic energy from one location to another without necessarily involving physical contact between the two locations, and in reference to an embodiment disclosed herein more particularly refers to an interaction between a signal source having an electromagnetic resonant frequency that coincides with an electromagnetic resonant mode of the associated dielectric structure 2000. A single one of the combination of a dielectric structure 2000 and a corresponding electromagnetically reflective metal fence structure 3500, as depicted in FIG. 1A for example, is herein referred to as a unit cell 1020.

As depicted in FIG. 4, the dielectric 3140 and the metal fence structure 3500 each have axially aligned through holes 3030, 3530, respectively, that define a location of the at least one support portion 3020 of the substrate 3200. In an embodiment, each of the at least one mount portion 4020 is disposed in a one-to-one correspondence with each of the at least one support portion 3020. In an embodiment, each of the at least one mount portion 4020 is adhered or otherwise fixed to a corresponding one of the at least one support portion 3020. FIG. 4 depicts and M×N array 3000 having a six-wide plurality of dielectric structures 2000 where M=6. In an embodiment, N may equal 6 also, or may equal any number of dielectric structures 2000 suitable for a purpose disclosed herein. Furthermore, it will be appreciated that the number of M×N dielectric structures in a given array as disclosed herein is merely for illustration purposes, and that the values for both M and N may be any number suitable for a purpose disclosed herein. As such, any M×N array falling within the scope of the invention disclosed herein is contemplated.

Reference is now made to FIG. 5A through FIG. 10.

Figure 5B:
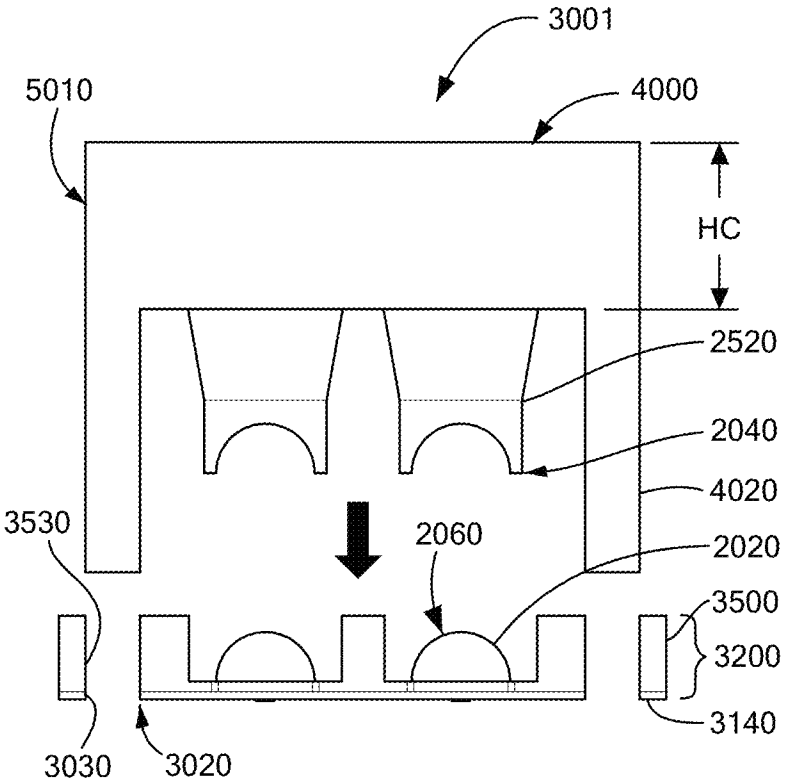
FIG. 5B depicts a side view of a disassembled assembly of the M×N array of FIG. 5A, in accordance with an embodiment.
Figure 5A:
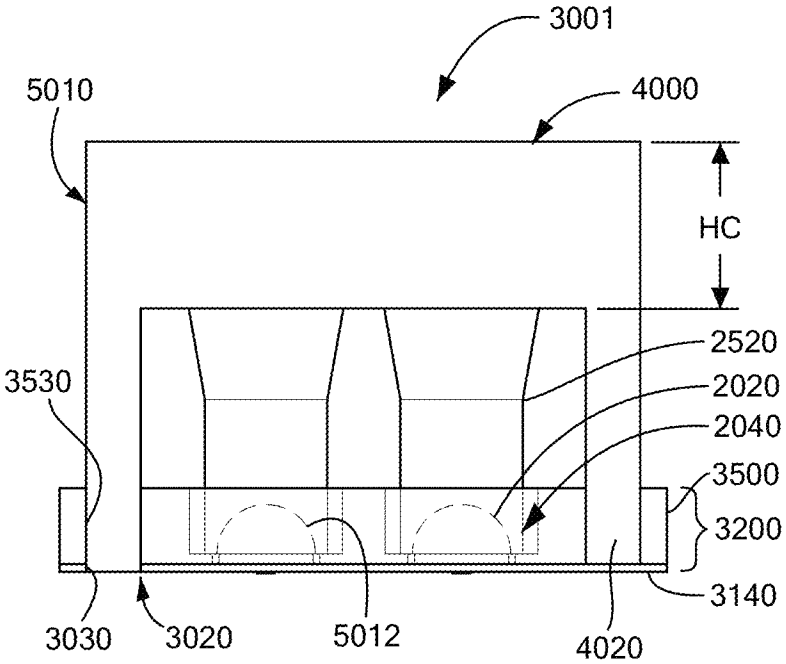
FIG. 5A depicts a side view of an M×N array, where M=2, of a plurality of unit cells of FIG. 1B, in accordance with an embodiment.

FIG. 5A depicts an M×N array 3001 where M=2 and N is unrestricted, similar to the array 3000 of FIG. 4, where the dielectric 3140 and the metal fence structure 3500 each have axially aligned through holes 3030, 3530, respectively, that define a location of the respective support portions 3020 of the substrate 3200, and the respective mount portions 4020 are disposed within the corresponding through holes 3030, 3530 of the dielectric 3140 and metal fence structure 3500, respectively. FIG. 5B depicts the array 3001 of FIG. 5A prior to assembly of the monolithic structure 5010, similar to monolithic structure 5000 described herein above, to the substrate 3200. As depicted, the array 3001 is a connected array having a connecting structure 4000, the lower Dk material of the second dielectric portion 2520 covers all sides of the higher Dk material of the first dielectric portion 2020, as depicted at the proximal end 2040 of the second dielectric portion 2520, and the second dielectric portion 2520 is in direct intimate contact with the first dielectric portion 2020, as depicted by dashed lines 5012 in FIG. 5A.

Figure 6B:
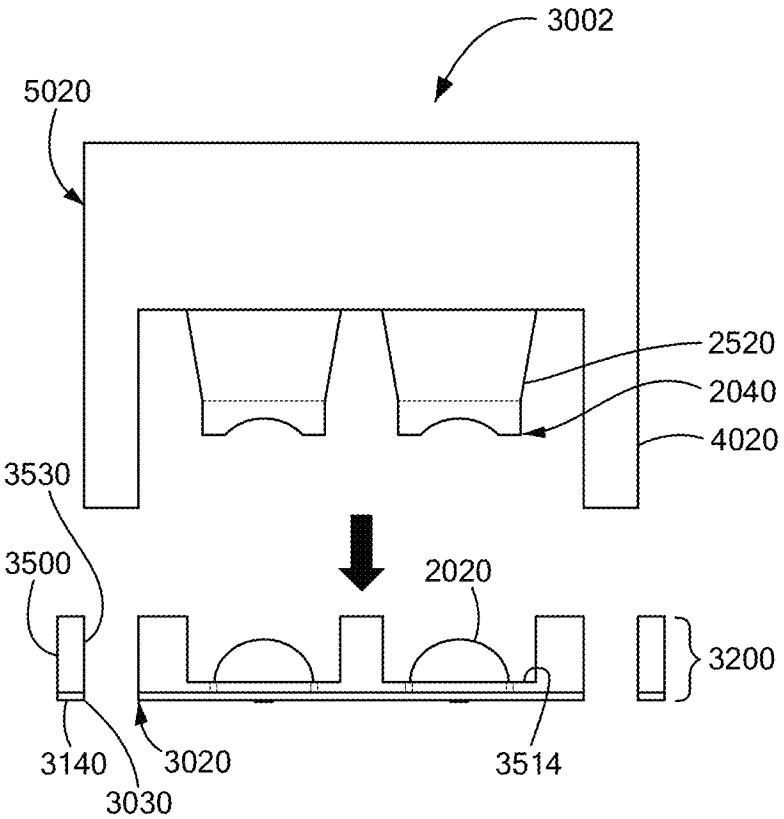
FIG. 6B depicts a side view of a disassembled assembly of the M×N array of FIG. 6A, in accordance with an embodiment.
Figure 6A:
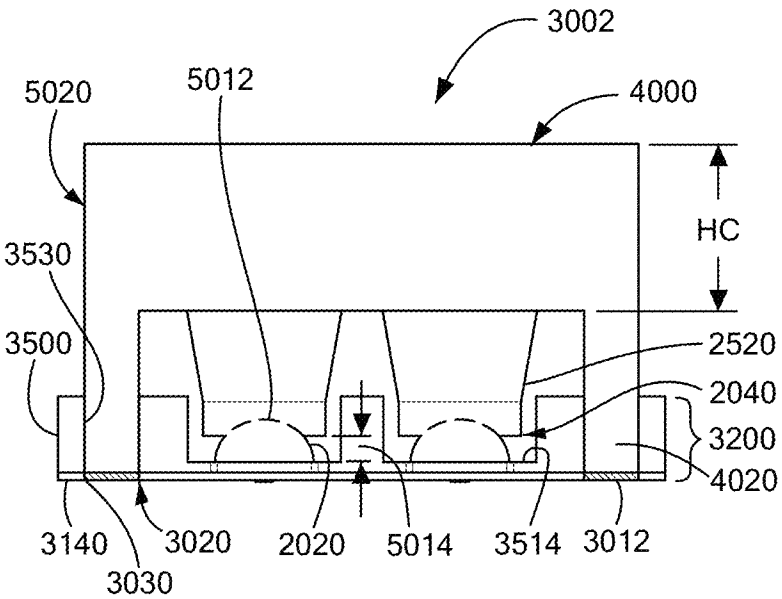
FIG. 6A depicts a side view of an M×N array, where M=2, of a plurality of unit cells similar but alternative to that of FIG. 5A, in accordance with an embodiment.

FIG. 6A depicts an M×N array 3002 where M=2 and N is unrestricted, similar to the array 3001 of FIG. 5A, where the dielectric 3140 and the metal fence structure 3500 each have axially aligned through holes 3030, 3530, respectively, that define a location of the at least one support portion 3020 of the substrate 3200, and the respective mount portions 4020 are disposed within the corresponding through holes 3530 of the metal fence structure 3500, but not the through holes 3030 the dielectric 3140. In an embodiment, the through holes 3030 of the dielectric 3140 are filled with a bonding material 3012, such as an adhesive, that secures the mount portions 4020 of the monolithic structure 5020, similar to monolithic structure 5010 depicted in FIG. 5A, to the substrate 3200. FIG. 6B depicts the array 3002 of FIG. 6A prior to assembly of the monolithic structure 5020 to the substrate 3200. As depicted, the array 3002 is a connected array having a connecting structure 4000, the lower Dk material of the second dielectric portion 2520 does not cover all sides of the higher Dk material of the first dielectric portion 2020, as depicted at the proximal end 2040 of the second dielectric portion 2520 where a gap 5014 is present between the proximal end 2040 of the second dielectric portion 2520 and the electrically conductive base 3514 of the metal fence structure 3500 upon which the first dielectric portion 2020 is disposed, and the second dielectric portion 2520 is in direct intimate contact with the first dielectric portion 2020, as depicted by dashed lines 5012 in FIG. 5A.

Figure 7A:
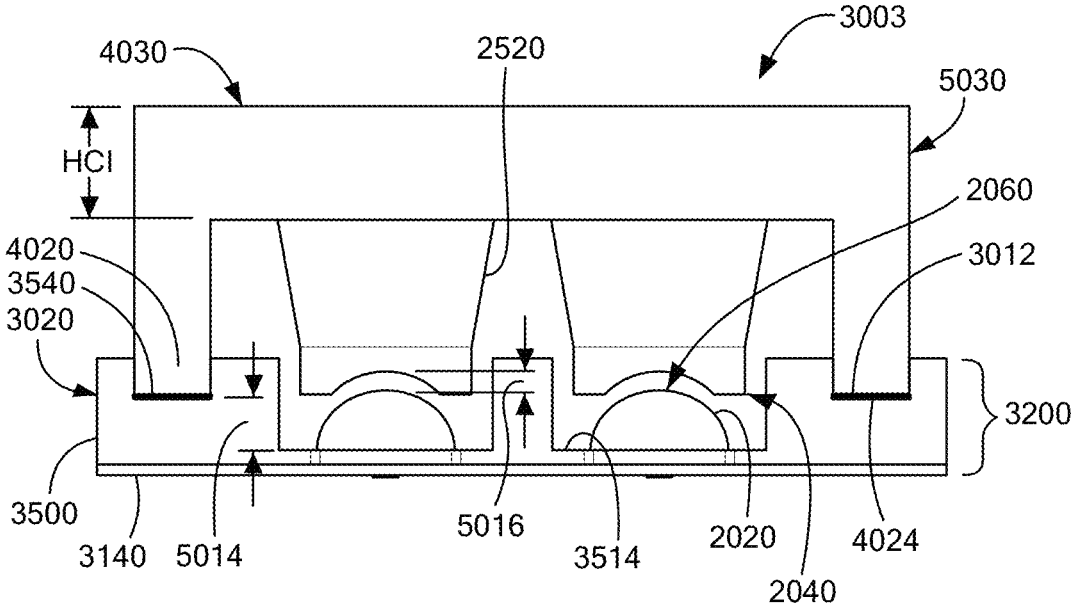
FIG. 7A depicts a side view of an M×N array, where M=2, of a plurality of unit cells similar but alternative to that of FIGS. 5A and 6A, in accordance with an embodiment.
Figure 7B:
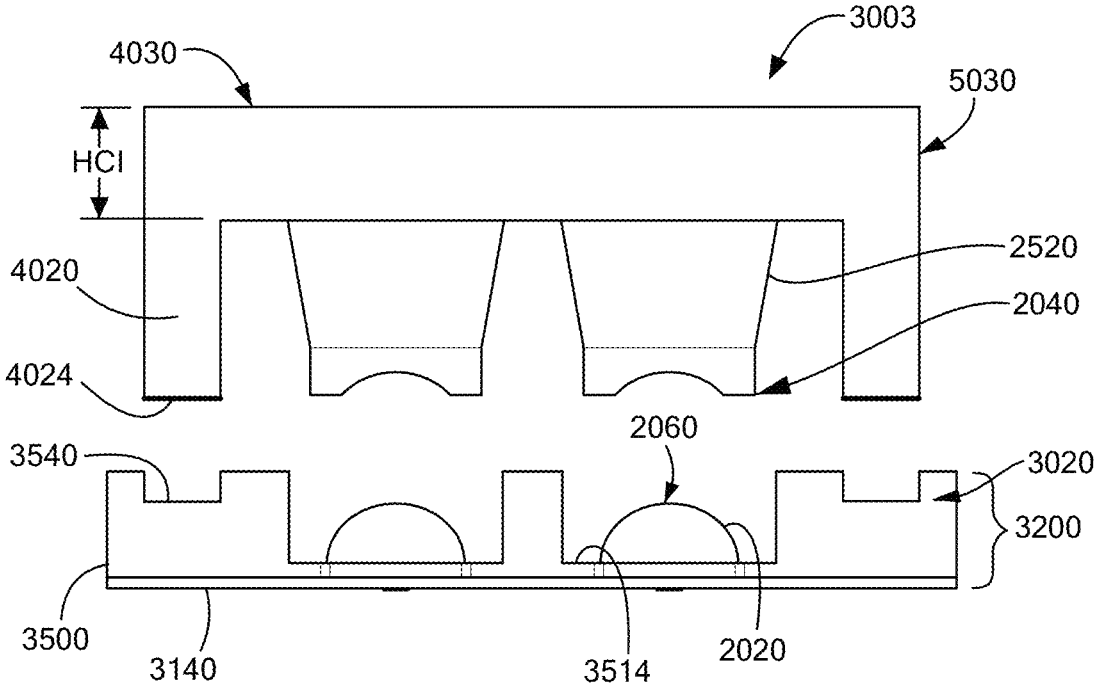
FIG. 7B depicts a side view of a disassembled assembly of the M×N array of FIG. 7A, in accordance with an embodiment.

FIG. 7A depicts an M×N array 3003 where M=2 and N is unrestricted, similar to the arrays 3001, 3002 of FIGS. 5A and 6A, respectively, but with some alternative features. As depicted in FIG. 7A, the dielectric 3140 is absent a through hole in the region of the mount portions 4020 of the connecting structure 4030, similar but alternative to connecting structure 4000, and the metal fence structure 3500 has recessed support surfaces 3540 upon which the mount portions 4020 are seated, forming the at least one support portion 3020. In an embodiment, a bonding material 3012 secures the mount portions 4020 of the monolithic structure 5030, similar to monolithic structures 5010, 5020, to the recessed support surfaces 3540. FIG. 7B depicts the array 3003 of FIG. 7A prior to assembly of the monolithic structure 5030 to the substrate 3200. Stated alternatively, each support portion 3020 of the substrate 3200 includes an upward facing support surface 3540, and each mount portion 4020 of the connecting structure 4030 includes a downward facing mount surface 4024 disposed in face-to-face engagement with a corresponding one of the upward facing support surface 3540.

As depicted, the array 3003 is a connected array having a connecting structure 4030, the lower Dk material of the second dielectric portion 2520 does not cover all sides of the higher Dk material of the first dielectric portion 2020, as depicted at the proximal end 2040 of the second dielectric portion 2520 where a gap 5014 is present between the proximal end 2040 of the second dielectric portion 2520 and the electrically conductive base 3514 of the metal fence structure 3500 upon which the first dielectric portion 2020 is disposed, and the second dielectric portion 2520 is disposed a distance away from the distal end 2060 of the first dielectric portion 2020, as depicted by gap 5016 in FIG. 7A. In comparing the connecting structure 4030 of FIG. 7A with the connecting structure 4000 of FIG. 5A, the connecting structure 4000 has a cross sectional overall height HC, and the connecting structure 4030 has a cross sectional overall height HCl, where HCl is less than HC. In an embodiment, HCl is equal to or less than one times λ, where λ is a freespace wavelength at an operating center frequency of the EM device 1000. Alternatively, in an embodiment, HCl is equal to or less than one-half times λ. Alternatively, in an embodiment, HCl is equal to or less than one-quarter times λ. Alternatively, in an embodiment, HCl is equal to or less than one-fifth times λ. Alternatively, in an embodiment, HCl is equal to or less than one-tenth times λ.

Figure 8A:
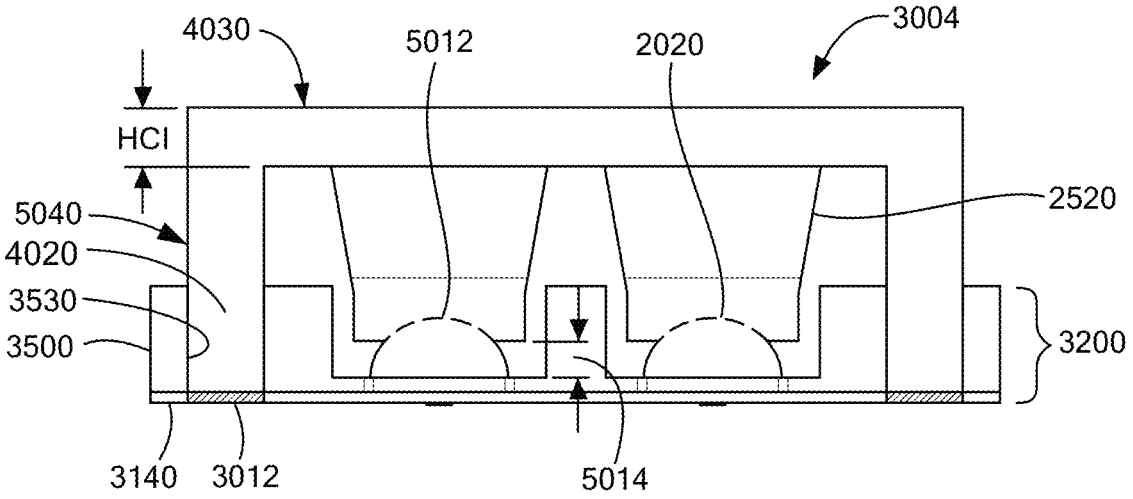
FIG. 8A depicts a side view of an M×N array, where M=2, of a plurality of unit cells similar but alternative to that of FIG. 6A, in accordance with an embodiment.

FIG. 8A depicts an M×N array 3004 where M=2 and N is unrestricted, similar to the array 3004 of FIG. 6A, but where the height of the connecting structure is HCl as opposed to HC. Other like features in FIGS. 8 and 6A are numbered alike.

Figure 8B:
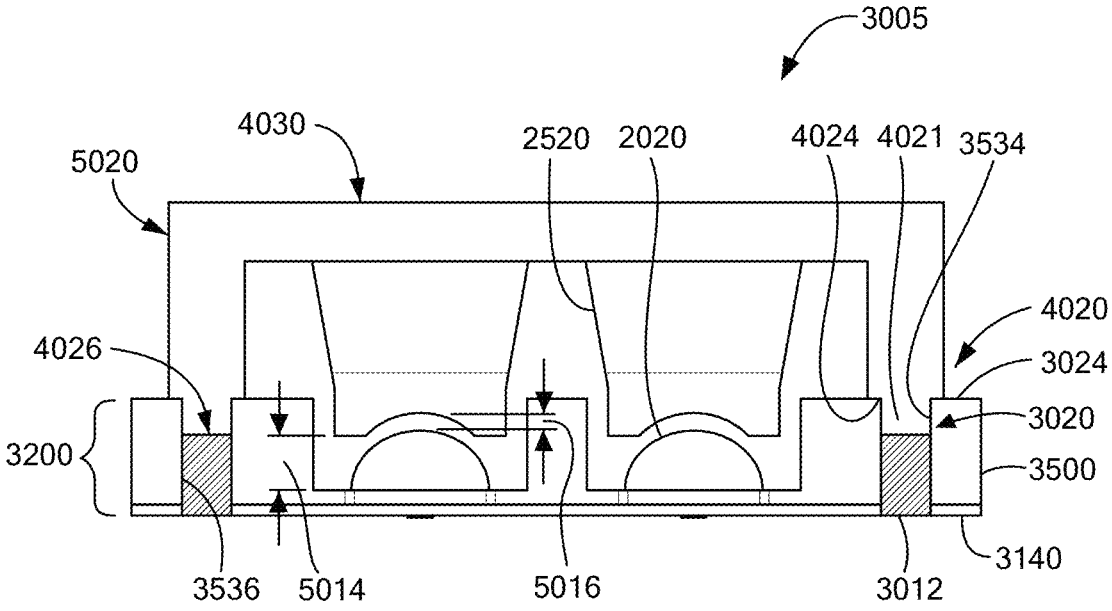
FIG. 8B depicts a side view of an M×N array, where M=2, of a plurality of unit cells similar but alternative to that of FIG. 7A, in accordance with an embodiment.

FIG. 8B depicts an M×N array 3005 where M=2 and N is unrestricted, similar to the combination of the array 3003 of FIG. 7A having gaps 5014 and 5016, and the array 3004 of 8A having bonding material 3012, but with alternative mount features. In an embodiment, each supporting portion 3020 of the substrate 3200 includes an upward facing shoulder 3024 formed in the metal fence structure 3500, and each mount portion 4020 of the monolithic structure 5020 includes a downward facing shoulder 4024 disposed on a corresponding one of the upward facing shoulder 3024, with a reduced cross section distal end 4026 of the mount portion 4020 that engages with an opening, or through hole, 3534 in the metal fence structure 3500. A void 3536 formed in the metal fence structure 3500 below the distal end 4026 of the mount portion 4020 is filled with the bonding material 3012 to secure the monolithic structure 5020 to the substrate 3200.

With reference to FIGS. 6A, 8A and 8B, it can be seen that an embodiment includes an arrangement where the corresponding mount portion 4020 is disposed only partially within a corresponding one of the through holes 3030, 3530, 3534 of the metal fence structure 3500, and a bonding material 3012 is disposed at least partially in the remaining through hole portions of the metal fence structure 3500 and the corresponding through holes of the substrate 3200.

With reference to FIG. 8B, it can be seen that an embodiment includes an arrangement where the mount portions 4020 of the connecting structure 4030 forms a post (referred to by reference numeral 4020) with a stepped-down post end 4021, and the stepped-down post end 4021 is disposed partially within the corresponding through hole 3534 of the metal fence structure 3500. In an embodiment, the post 4020 and the stepped-down post end 4021 are cylindrical.

Figure 9A:
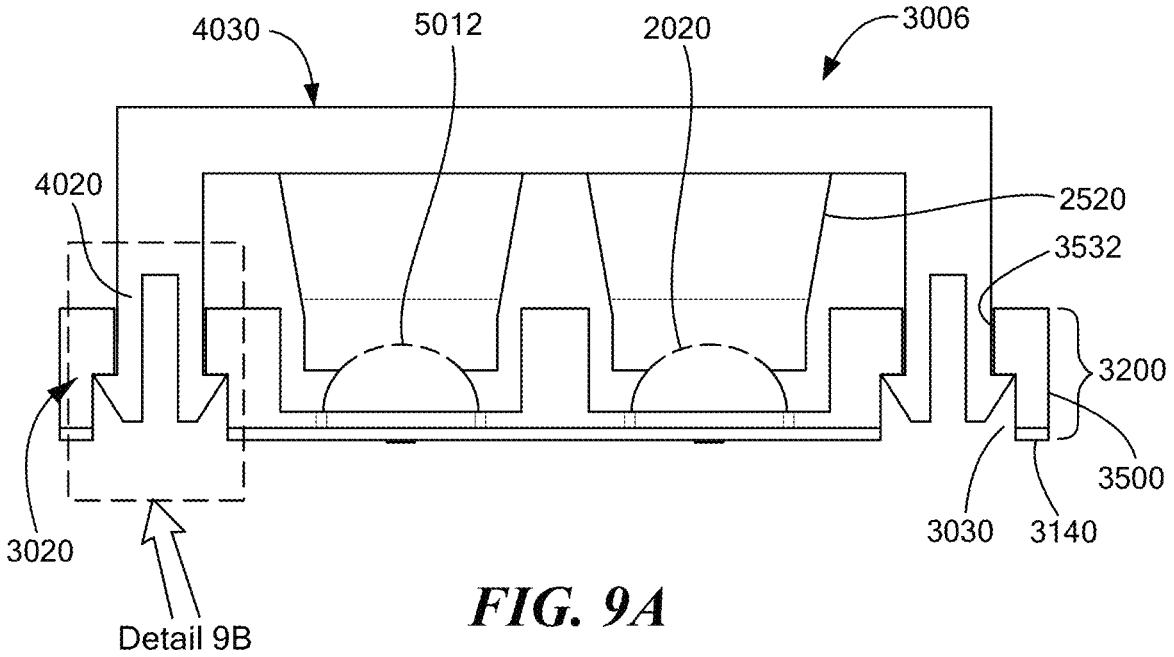
FIG. 9A depicts a side view of an M×N array, where M=2, of a plurality of unit cells similar but alternative to that of FIG. 8A, in accordance with an embodiment.
Figure 9B:
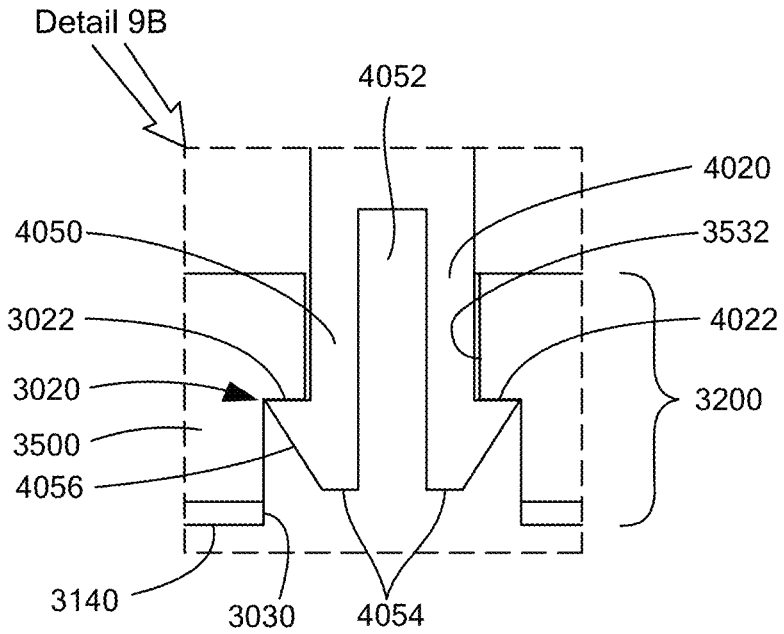
FIG. 9B depicts an enlarged view of Detail 9B of FIG. 9A.

FIG. 9A depicts an M×N array 3006 where M=2 and N is unrestricted, similar to the array 3004 of FIG. 8A, but with alternative mount features, and FIG. 9B Detail-9B shown in FIG. 9A. In an embodiment, each support portion 3020 of the substrate 3200 includes a downward facing undercut shoulder 3022 formed in the metal fence structure 3500, and each mount portion 4020 of the connecting structure 4030 includes an upward facing snap-fit shoulder 4022 disposed in snap-fit engagement with the corresponding downward facing undercut shoulder 3022 via an opening 3532 in the metal fence structure 3500. While FIGS. 9A and 9B depict a through holes 3030 in the dielectric 3140, it will be appreciated that such a through holes 3030 may not be necessary depending on the dimensions of the snap-fit leg 4050 of the connecting structure 4030. In an embodiment, the snap-fit leg 4050 includes an open central region 4052, which permits the side portions 4054 to flex inward to facilitate the aforementioned snap-fit engagement. A tapered nose 4056 on the distal end of the mount portion 4020 facilitates entry of the mount portion 4020 into the opening 3532.

Figure 10:
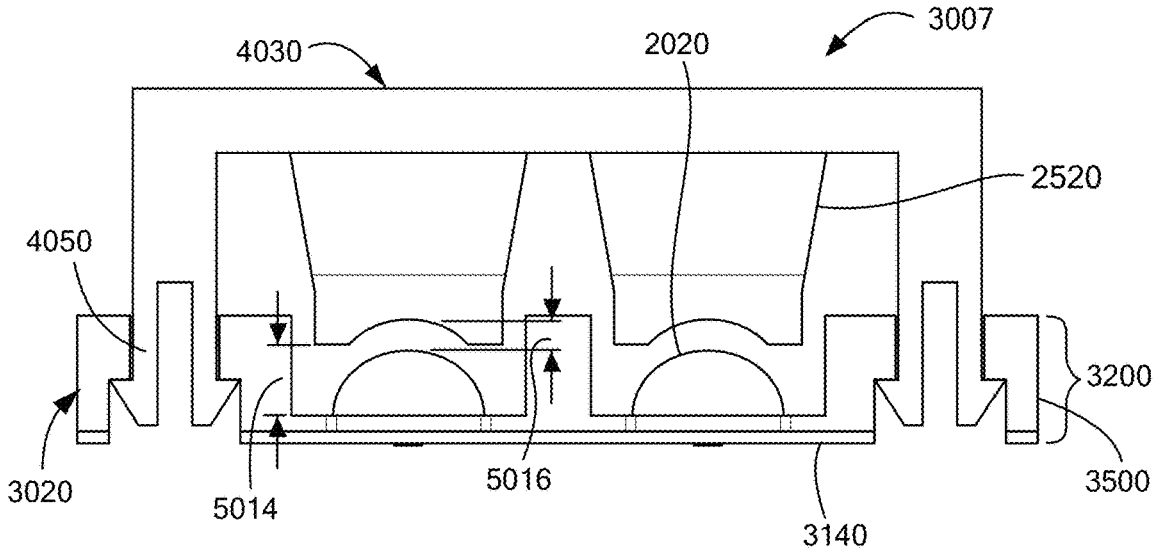
FIG. 10 depicts a side view of an M×N array, where M=2, of a plurality of unit cells similar but alternative to that of FIG. 9A, in accordance with an embodiment.

FIG. 10 depicts an M×N array 3007 where M=2 and N is unrestricted, which is similar to the combination of array 3003 of FIG. 7A having gaps 5014 and 5016, and array 3005 of FIG. 9A having snap-fit legs 4050. Other like features between FIGS. 10, 9A and 7A are numbered alike.

As can be seen by the foregoing descriptions of FIGS. 1-4 in combination with FIGS. 5A-10, many EM device features disclosed herein are interchangeable and usable with other EM device features disclosed herein. As such, it will be appreciated that while not all combinations of EM device features are illustrated and specifically described herein, one skilled in the art would appreciate that substitutions of one EM device feature for another EM device feature may be employed without detracting from the scope of an invention disclosed herein. Accordingly, any and all combinations of EM device features as disclosed herein are contemplated and considered to fall within the ambit of an invention disclosed herein.

Figure 11:
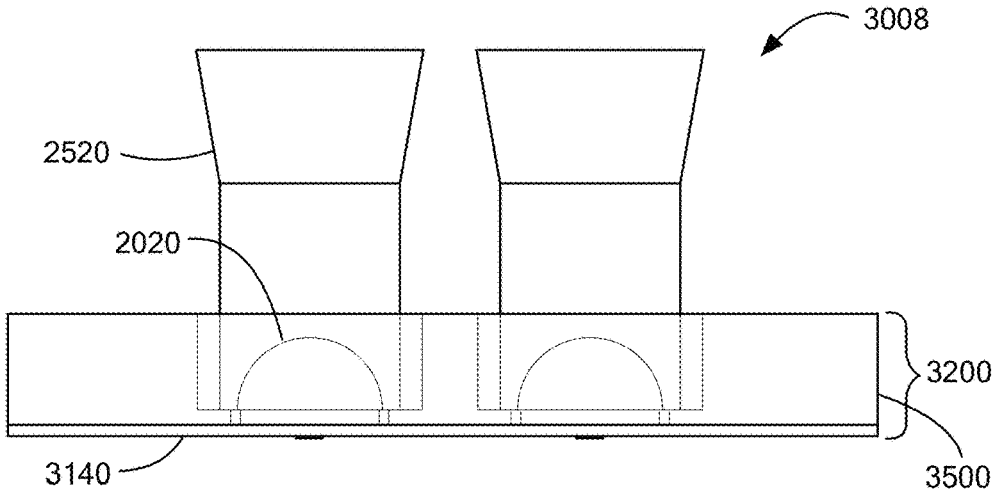
FIG. 11 depicts a side view of an M×N array, where M=2, of a plurality of unit cells similar but alternative to that of FIG. 5A, in accordance with an embodiment.
Figure 12:
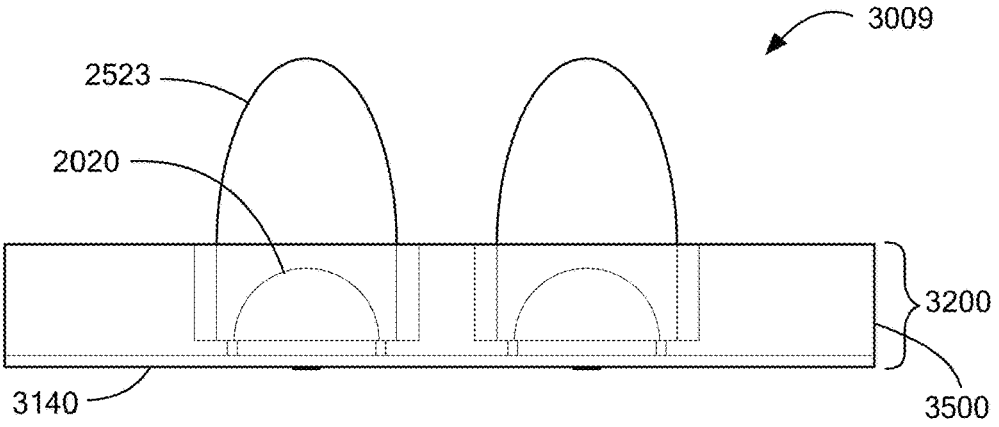
FIG. 12 depicts a side view of an M×N array, where M=2, of a plurality of unit cells similar but alternative to that of FIG. 11, in accordance with an embodiment.

Reference is now made to FIGS. 11-12.

FIG. 11 depicts an M×N array 3008 where M=2 and N is unrestricted, similar to the array 3001 of FIG. 5A, but absent the connecting structure 4000 depicted in FIG. 5A. Other like features between FIGS. 11 and 5A are numbered alike.

FIG. 12 depicts an M×N array 3009 where M=2 and N is unrestricted, similar to the array 3007 of FIG. 11, absent a connecting structure 4000, and having a second dielectric portion 2523 similar to that depicted in FIG. 3. Other like features between FIGS. 12 and 11 are numbered alike.

As can be seen by the foregoing descriptions and/or illustrations of FIGS. 1-12, embodiments of the invention may or may not include a connecting structure 4000, and still perform in accordance with an embodiment of an invention disclosed herein. As such, it is contemplated that any embodiment disclosed herein including a connecting structure may be employed absent such connecting structure, and any embodiment disclosed herein absent a connecting structure may be employed with such connecting structure.

Figure 13:
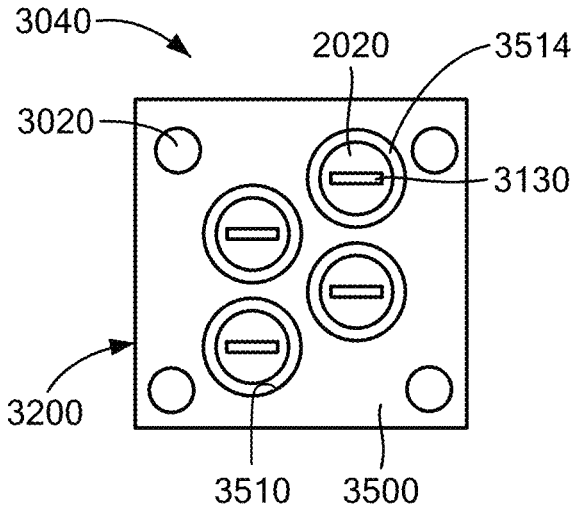
FIG. 13 depicts a plan view of an M×N array, where M=2 and N=2, of a plurality of first dielectric portions on a substrate, in accordance with an embodiment.
Figure 14A:
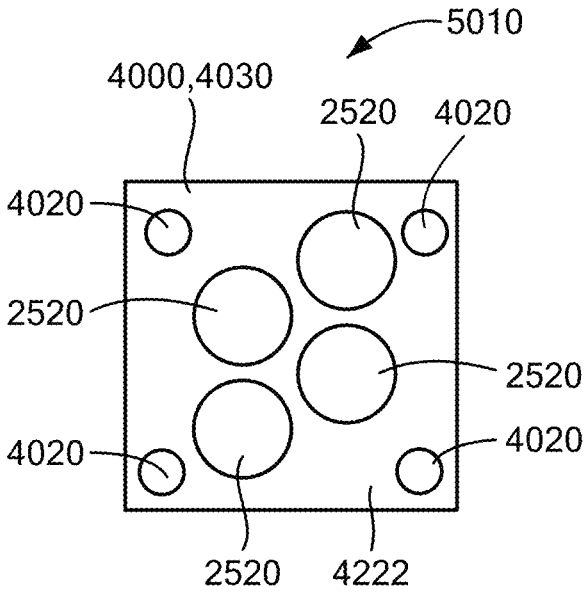
FIG. 14A depicts a plan view of a monolithic structure including an M×N array, where M=2 and N=2, of a plurality of second dielectric portions, and a plurality of mount portions, interconnected via a connecting structure, in accordance with an embodiment.
Figure 14B:
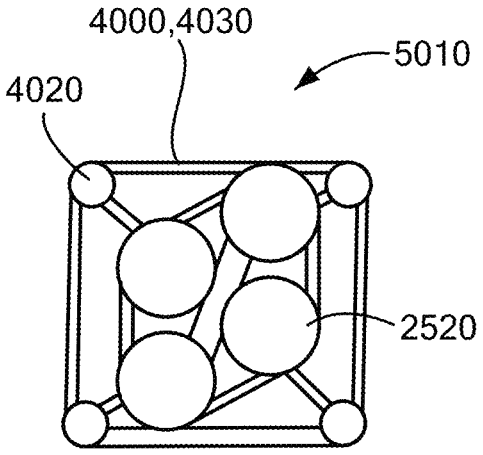
FIG. 14B depicts a plan view of a monolithic structure similar but alternative to that of FIG. 14A, in accordance with an embodiment.

Reference is now made to FIG. 13, which depicts an example plan view embodiment of M×N array 3040 where M=2 and N=2, but where the invention is not so limited to a 2×2 array. The array 3040 is representative of any of the foregoing arrays 3001, 3002, 3003, 3004, 3005, 3006, 3007, depicted in FIGS. 5A, 6A, 7A, 8A, 8B, 9A, 10, respectively, absent the corresponding second dielectric portion 2520, 2523, connecting structure 4000, 4030, and/or monolithic structure 5020. As depicted, the array 3040 includes the substrate 3200 with the metal fence structure 3500 having the electrically conductive electromagnetic reflectors 3510 and the electrically conductive base 3514 (the dielectric 3140 being hidden from view), the first dielectric portion 2020, a slotted feed aperture 3130 (which could be replaced with any of the foregoing feed structures), and support portions 3020. Reference is now made to FIG. 14A in combination with FIG. 13, where FIG. 14A depicts the monolithic structure 5010 prior to assembly to the substrate 3200. As depicted, the monolithic structure 5010 has a plurality of second dielectric portions 2520, a plurality of mount portions 4020, and the connecting structure 4000, 4030. While the connecting structure 4000, 4030 is illustrated as completely filling the space between the second dielectric portions 2520 and the mount portions 4020, it will be appreciated that this is for illustration purposes only, and that the connecting structure 4000, 4030 need only have connection branches that interconnect the second dielectric portions 2520 and the mount portions 4020 to form the monolithic structure 5010. See for example FIG. 14B depicting the same second dielectric portions 2520 and mount portions 4020 as those depicted in FIG. 14A, but with the connecting structure 4000, 4030 being a plurality of interconnected ribs, where the combination forms the monolithic structure 5010. A comparison between FIG. 14A and at least FIGS. 5A and 7A will show that the connecting structure 4000, 4030 is disposed at a distance away from the substrate 3200, which may be occupied by air or some non-gaseous dielectric material. Those portions of the monolithic structure 5010 that are disposed a distance away for the substrate 3200 are also herein referred to as a non-attachment zone 4222.

Figure 15:
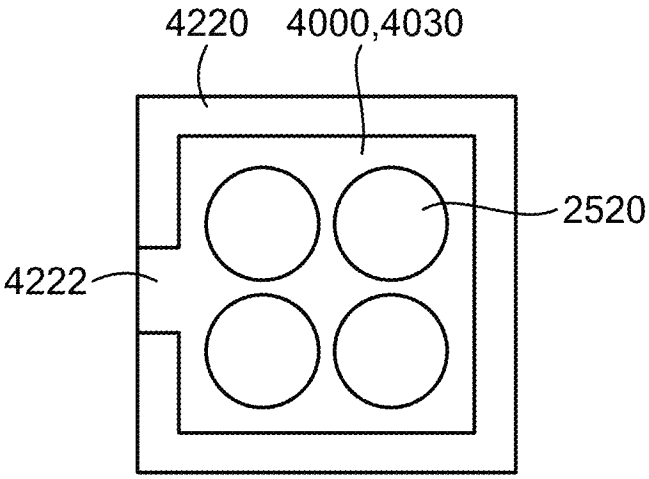
FIG. 15 depicts a plan view of a monolithic structure similar but alternative to that of FIGS. 14A-14B, in accordance with an embodiment.
Figure 16:
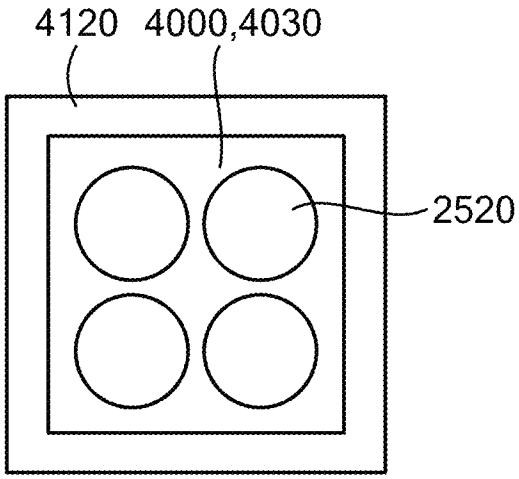
FIG. 16 depicts a plan view of a monolithic structure similar but alternative to that of FIGS. 14A-15, in accordance with an embodiment.
Figure 17:
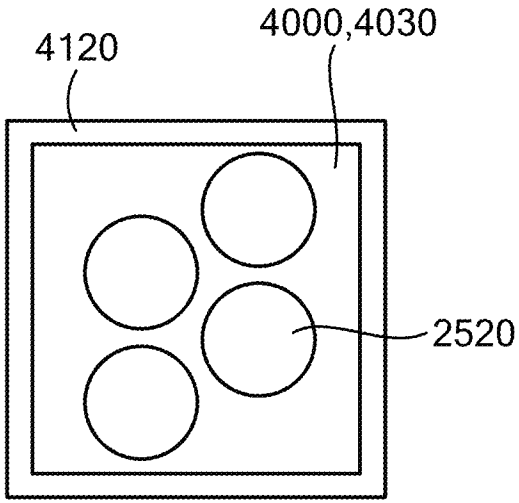
FIG. 17 depicts a plan view of a monolithic structure similar but alternative to that of FIGS. 14A-16, in accordance with an embodiment.
Figure 18:
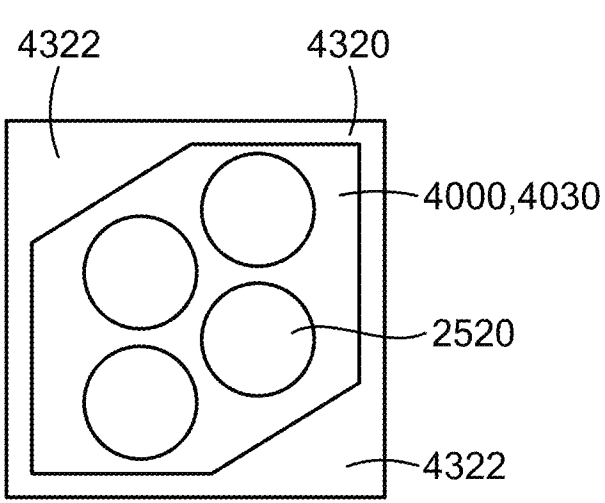
FIG. 18 depicts a plan view of a monolithic structure similar but alternative to that of FIGS. 14A-17, in accordance with an embodiment.
Figure 19:
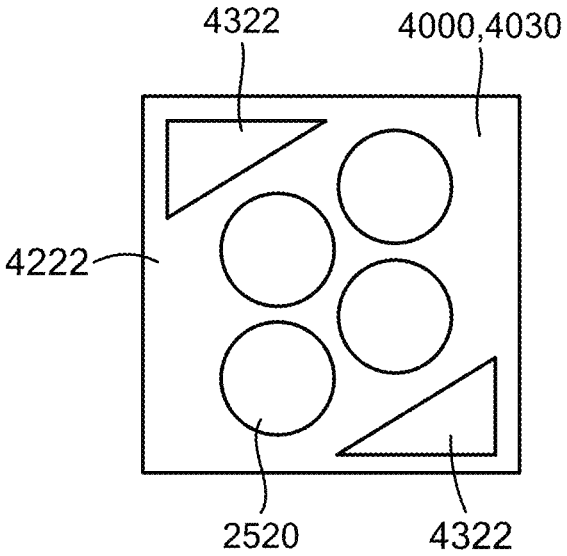
FIG. 19 depicts a plan view of a monolithic structure similar but alternative to that of FIGS. 14A-18, in accordance with an embodiment.
Figure 20:
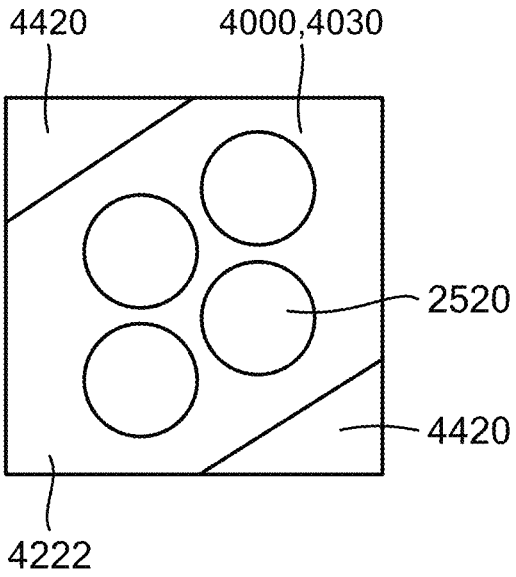
FIG. 20 depicts a plan view of a monolithic structure similar but alternative to that of FIGS. 14A-19, in accordance with an embodiment.
Figure 21:
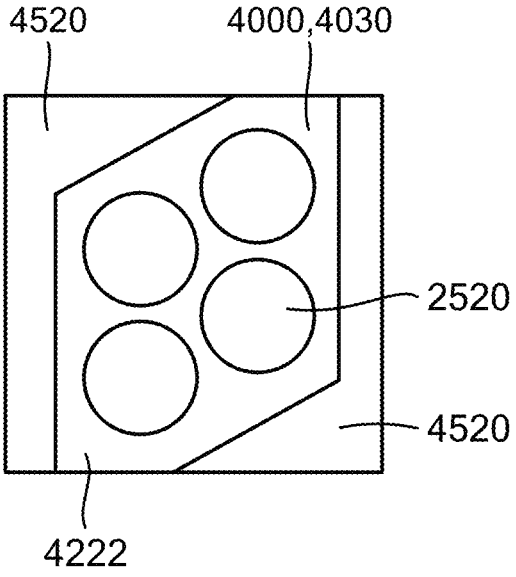
FIG. 21 depicts a plan view of a monolithic structure similar but alternative to that of FIGS. 14A-20, in accordance with an embodiment.

Reference is now made to FIGS. 15-21, which depict alternative arrangements for the mount portions 4020, the array layout of the dielectric structures 2000 where only the second dielectric portions 2520 of the dielectric structures 2000 are depicted in FIGS. 15-21, and the resulting connecting structure 4000, 4030. In FIG. 15 the second dielectric portions 2520 are arranged in a rectilinear layout, and the mount portions 4120 are arranged to completely surround the second dielectric portions 2520 (and the resulting dielectric structures 2000). In FIG. 16 the second dielectric portions 2520 are arranged in a rectilinear layout, and the mount portions 4220 are arranged to partially surround the second dielectric portions 2520, with at least one non-attachment region 4222 being present between the monolithic and the substrate. In FIG. 17 the second dielectric portions 2520 are arranged in a non-rectilinear layout, and the mount portions 4120 are arranged to completely surround the second dielectric portions 2520, similar to that of FIG. 15. In FIG. 18 the second dielectric portions 2520 are arranged in a non-rectilinear layout, and the mount portions 4320 are arranged to completely surround the second dielectric portions 2520, similar to that of FIGS. 15 and 17, but with additional thicker mount portions 4322 placed in strategic locations such as the corners of the array for example. In FIG. 19 the second dielectric portions 2520 are arranged in a non-rectilinear layout, and the mount portions 4322 are formed via the additional thicker mount portions 4322 depicted in FIG. 18 absent the surrounding mount portions 4320 depicted in FIG. 18, resulting in at least one non-attachment region 4222 being present between the monolithic and the substrate. In FIG. 20 the second dielectric portions 2520 are arranged in a non-rectilinear layout, and the mount portions 4420 are formed via the additional thicker mount portions 4322 depicted in FIG. 18 with just a portion of the surrounding mount portions 4320 depicted in FIG. 18, resulting in at least one non-attachment region 4222 being present between the monolithic and the substrate. In FIG. 21 the second dielectric portions 2520 are arranged in a non-rectilinear layout, and the mount portions 4520 are formed via the additional thicker mount portions 4322 depicted in FIG. 18 with additional portions of the surrounding mount portions 4320 depicted in FIG. 18, resulting in at least one non-attachment region 4222 being present between the monolithic and the substrate. The connecting structures 4000, 4030 of FIGS. 15-21 may be formed to interconnect the corresponding mount portions 4120, 4220, 4222, 4320, 4322, 4420, 4520 and the second dielectric portions 2520 in any manner consistent with the disclosure herein.

From the foregoing, it will be appreciated that an embodiment of the invention includes an EM device 1000 where each of the at least one support portion 3020 of the substrate 3200 and the corresponding one of the at least one mount portion 4020, 4120, 4220, 4222, 4320, 4322, 4420, 4520 of the connecting structure 4000, 4030 are attached to each other to define a first attachment zone 4020, 4120, 4220, 4222, 4320, 4322, 4420, 4520, each one of the first dielectric portions 2020 of the array 3000, 3001, 3002, 3003, 3004, 3005, 3006, 3007, 3008, 3009 and the substrate 3200 are attached to each other to define a second attachment zone (aggregate of contact regions between the first dielectric portions 2020 and the substrate 3200), and a zone between the single monolithic structure 5000, 5010 and the substrate 3200 that is other than the first attachment zone or the second attachment zone defines a non-attachment zone 4222. In an embodiment, the first attachment zone at least partially surrounds the second attachment zone. Alternatively in an embodiment, the first attachment zone completely surrounds the second attachment zone.

From the foregoing, it will be appreciated that there are many variations, too many to list exhaustively, for configuring the mount portions and connecting structures, as well as the layout of the dielectric structures, for providing an embodiment consistent with the disclosure herein. Any and all such arrangements consistent with the disclosure herein are contemplated and considered to fall within the scope of an invention disclosed herein.

Figure 22:
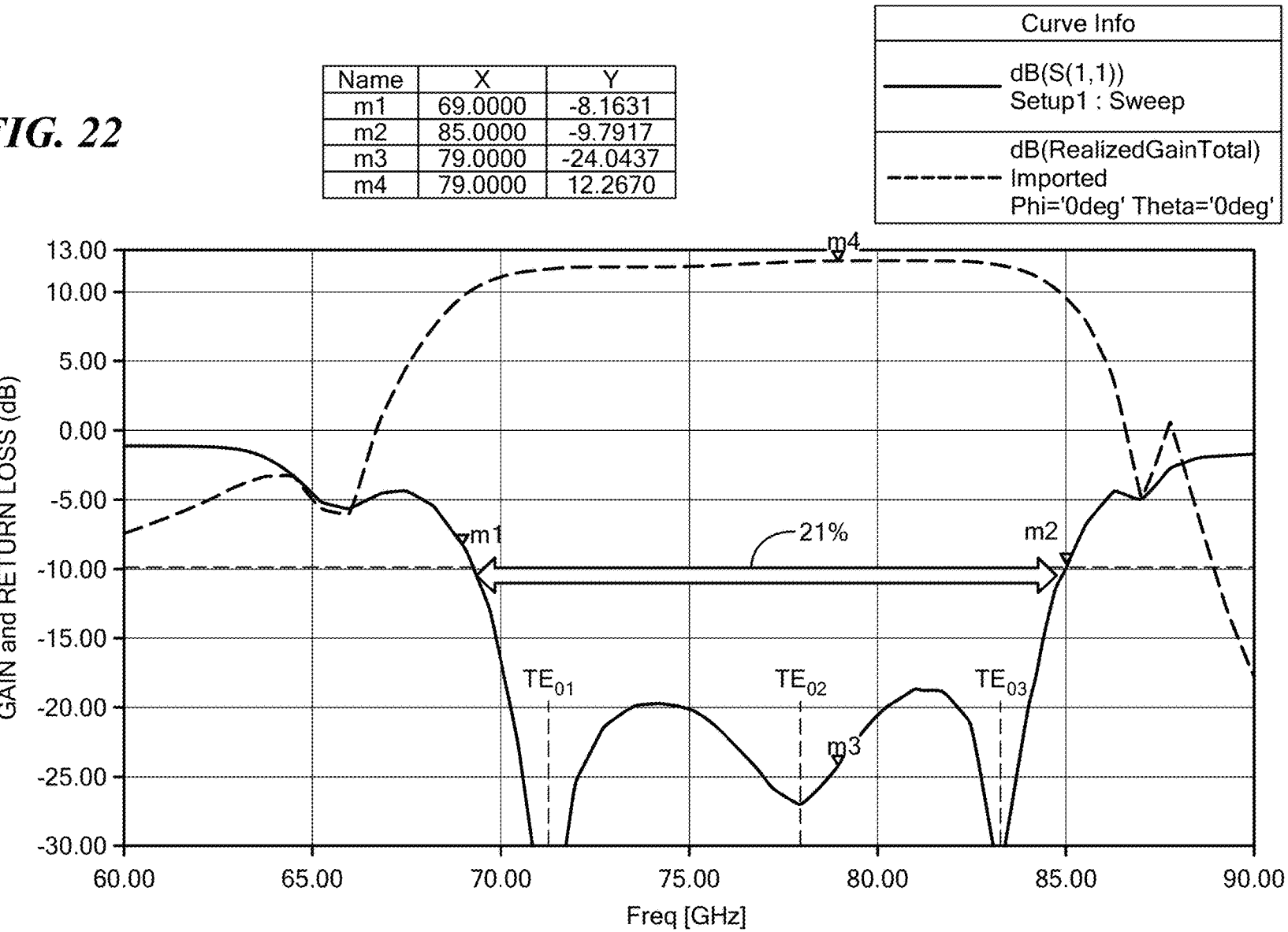
FIG. 22 depicts mathematical modeling performance characteristics a single unit cell, in accordance with an embodiment.
Figure 23:
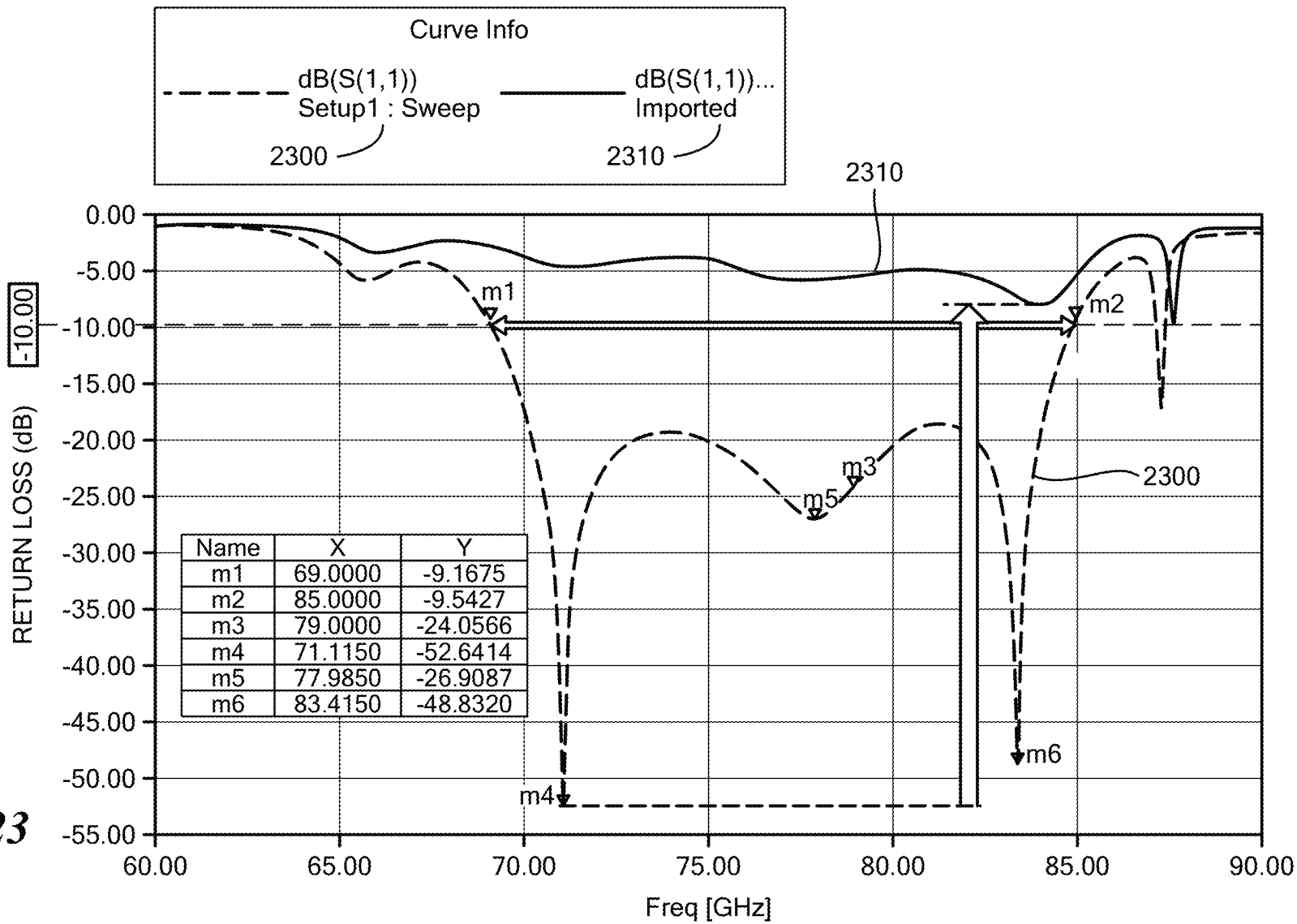
FIG. 23 depicts mathematical performance characteristics comparing the S(1, 1) return loss performance characteristics of a unit cell according to an embodiment, with a similar unit cell but absent an element according to the embodiment, in accordance with an embodiment

Reference is now made to FIGS. 22-23, which illustrate mathematical modeling data showing the advantages of an example embodiment disclosed herein and generally represented by FIGS. 7A, 13 and 14A. FIG. 22 depicts the performance characteristics, more particularly the dBi gain and S(1, 1) return loss, for a single radiating dielectric structure 2000, more particularly a single unit cell 1020, having both the first dielectric portion 2020 and the second dielectric portion 2520 of an embodiment disclosed herein. As depicted, the bandwidth is 21% at −10 dBi between 69 GHz and 85 GHz, the gain is substantially constant with a peak of 12.3 dBi at 79 GHz in the 21% bandwidth, and three of the resonant modes in the 21% bandwidth are TE modes, $TE_{01}$, $TE_{02}$, $TE_{03}$. FIG. 23 depicts a comparison of the S(1, 1) return loss performance characteristics of the same unit cell 1020 as that associated with FIG. 22, with and without the second dielectric portion 2520, which is presented to illustrate the advantages of an embodiment disclosed herein. Curve 2300 depicts the S(1, 1) characteristic with the second dielectric portion 2520, and curve 2310 depicts the S(1, 1) characteristic absent the second dielectric portion 2520. As can be seen, use of the second dielectric portion 2520 enhances the minimum return loss by at least 40 dBi over the operating frequency range from 69 GHz to 85 GHz.

In view of the foregoing, it will be appreciated that an EM device 1000 as disclosed herein is operable having an operating frequency range having at least two resonant modes at different center frequencies, where at least one of the resonant modes is supported by the presence of the second dielectric portion 2520. In an embodiment, the at least two resonant modes are TE modes. It will also be appreciated that an EM device 1000 as disclosed herein is operable having an operating frequency range having at least three resonant modes at different center frequencies, where at least two of the at least three resonant modes are supported by the presence of the second dielectric portion 2520. In an embodiment, the at least three resonant modes are TE modes. In an embodiment, the EM device 1000 is operable having a minimum return loss value in an operating frequency range, and wherein removal of the second dielectric portion 2520 increases the minimum return loss value in the operating frequency range by at least 5 dBi, alternatively by at least 10 dBi, alternatively by at least 20 dBi, alternatively by at least 30 dBi, and further alternatively by at least 40 dBi.

With reference back to FIGS. 1C, 1D and at least FIG. 4, it will be appreciated that an embodiment includes a second dielectric portion 2550, alternatively herein referred to as an electromagnetic (EM) dielectric lens, having at least one lens portion (also herein referred to by reference numeral 2550) formed of at least one dielectric material, where the at least one lens portion 2550 has a cavity 2700 outlined by the boundary of the at least one dielectric material. In an embodiment, the at least one lens portion 2550 is formed from a plurality of layered lens portions (depicted by dashed lines 2552. In an embodiment, the plurality of lens portions 2550, 2552 are arranged in an array (see array 3000 in FIG. 4 for example). In an embodiment, the plurality of lens portions 2550, 2552 are connected (see connecting structure 4000 in FIG. 4 for example), where connection of the plurality of lens portions 2550, 2552 is provided by at least one dielectric material. In an embodiment, the EM dielectric lens 2550 is an all-dielectric structure.

In view of the foregoing description of structure of an EM device 1000 as herein disclosed, it will be appreciated that an embodiment also includes a method of making such EM device 1000, which includes: providing a substrate; disposing a plurality of first dielectric portions, FDPs, on the substrate, each FDP of the plurality of FDPs having a proximal end and a distal end and comprising a dielectric material other than air, the proximal end of each FDP being disposed on the substrate; disposing a second dielectric portion, SDP, proximate each FDP, each SDP having a proximal end and a distal end, the proximal end of each SDP being disposed proximate the distal end of a corresponding FDP, each SDP comprising a dielectric material other than air, the dielectric material of each FDP having an average dielectric constant that is greater than the average dielectric constant of the dielectric material of a corresponding SDP, each FDP and corresponding SDP forming a dielectric structure. In an embodiment of the method, each SDP is physically connected to at least one other of the SDPs via a connecting structure formed of a non-gaseous dielectric material, the connecting structure and the connected SDPs forming a single monolithic structure. In an embodiment of the method, the disposing a SDP includes disposing the single monolithic structure proximate each FDP. In an embodiment of the method, the single monolithic structure is a single dielectric material having a seamless and contiguous structure. In an embodiment of the method, the method further includes attaching the single monolithic structure to the substrate. In an embodiment of the method, the attaching includes attaching via bonding, posts of the single monolithic structure onto support platforms of the substrate. In an embodiment of the method, the attaching includes attaching via snap-fitting, snap-fit posts of the single monolithic structure into shouldered holes of the substrate. In an embodiment of the method, the attaching includes attaching stepped-down posts of the single monolithic structure only partially into through holes of the substrate, and applying a bonding material in the through holes to bond the posts to the substrate. In an embodiment of the method, the dielectric structure is an all-dielectric structure.

With general reference to the foregoing, reference is now made specifically to FIGS. 24A through 31, which depict alternative embodiments to those described hereinabove, and which are described herein below with reference to the following aspects.

Aspect-1 (see FIGS. 24A, 24B, and 24C, for example): An embodiment of an electromagnetic, EM, device 6100 (similar to EM device 1000 of FIG. 1A, but having an alternative EM signal feed and a plurality of alternative dielectric structures), comprises: a plurality of dielectric structures 6200, each dielectric structure of the plurality of dielectric structures comprising: a first dielectric portion, FDP, 6202 having a proximal end 6204 and a distal end 6206, the FDP 6202 comprising a dielectric material other than air; and a second dielectric portion, SDP, 6252 having a proximal end 6254 and a distal end 6256, the proximal end 6254 of the SDP 6252 being disposed proximate the distal end 6206 of the FDP 6202, the SDP 6252 comprising a dielectric material other than air; wherein the dielectric material of the FDP 6202 has an average dielectric constant that is greater than the average dielectric constant of the dielectric material of the SDP 6252; wherein the SDP 6252 has an overall height dimension HS as observed in a side elevation view (see FIG. 24B for example), and the proximal end 6254 of the SDP 6252 has an overall width dimension W1 as observed in a side elevation view (see FIG. 24B for example); wherein HS is equal to or greater than 2.5 times W1, and is equal to or less than 55 times W1.

Aspect-2: The device 6100 of Aspect-1, wherein HS is equal to or greater than 3 times W1.

Aspect-3: The device 6100 of Aspect1, wherein the SDP 6252 has a generally cylindrical shape.

Aspect-4: The device 6100 of Aspect-1, wherein the distal end 6256 of each SDP 6252 has a relatively thin connecting structure 6280 that integrally interconnects a neighboring SDP 6252.1, 6252.2, wherein the relatively thin connecting structure 6280 has a thickness t that is relatively thin in relation to W1. In an embodiment, t is equal to or greater than 0.1 times W1, and equal to or less than 0.5 times W1, or alternatively equal to or less than 0.2 times W1.

Aspect-5: The device 6100 of Aspect-1, further comprising: a substrate integrated waveguide, SIW, 6300 upon which the plurality of dielectric structures 6200 are disposed.

Aspect-6: The device 6100 of Aspect-5 (best seen with reference to FIG. 24C in combination with FIGS. 24A and 24B), wherein the SIW 6300 comprises: a lower electrically conductive layer 6302; an upper electrically conductive layer 6304; a dielectric layer 6306 disposed between the lower and the upper conductive layers 6302, 6304; a plurality of electrically conductive vias 6308 disposed between and in electrical communication with the lower and upper conductive layers 6302, 6304, the plurality of conductive vias 6308 arranged to form an electromagnetic, EM, waveguide 6310 of the SIW 6300; wherein a first portion 6320 of the SIW 6300 comprises a coplanar signal feed 6322 formed in the upper conductive layer 6304 via an absence 6324 of conductive material of the upper conductive layer 6304, the signal feed 6322 disposed to electromagnetically cooperate with the EM waveguide 6310; wherein a second portion 6330 of the SIW 6300 provides a support for the plurality of dielectric structures 6200 and is an extension of the first portion 6320 of the SIW 6300 (wherein the lower conductive layers 6302 of the first and second portions 6320, 633 are coplanar, and the upper conductive layers 6304 of the first and second portions 6320, 633 are coplanar), the plurality of dielectric structures 6200 disposed to electromagnetically cooperate with the EM waveguide 6310; wherein the signal feed 6322 is disposed on the first portion 6320 and not on the second portion 6330.

Aspect-7: The device 6100 of Aspect-6, wherein: the signal feed 6322 has a signal input region 6326 and a signal output region 6328; the signal output region 6328 being disposed a distance d from the second portion 6330; and d is greater than zero and equal to or less than $\lambda/20$, where $\lambda$ is an operational wavelength at an operating frequency of the device 6100.

Aspect-8: The device 6100 of Aspect-7, further comprising: an electromagnetic reflective, EMR, structure 6400 having a plurality of electromagnetic reflectors 6410, each reflector of the plurality of electromagnetic reflectors 6410 disposed around and in one-to-one correspondence with a corresponding one of the plurality of dielectric structures 6200; the EMR structure 6400 disposed in electrical communication with the upper conductive layer 6304 on the second portion 6330 of the SIW 6300.

Aspect-9: The device 6100 of Aspect-8, wherein: the EMR structure 6400 has a height HR that is equal to or less than 0.25 times HS.

Aspect-10: The device 6100 of Aspect-7, wherein: the coplanar signal feed 6322 has a signal input impedance of about 50 ohm, and a signal output impedance of greater than 50 ohm.

Aspect-11: The device 6100 of Aspect-7, wherein: a portion 6312 of the plurality of electrically conductive vias 6308 of the EM waveguide 6310 are disposed on each side of and are proximate the signal feed 6308, and are arranged relative to each other so as to form a wall of overlapping vias as observed in a side view (see FIG. 24B for example) of the SIW 6300 to reduce sideways signal leakage from the signal feed.

Aspect-12: The device 6100 of Aspect-7, wherein: each dielectric structure of the plurality of dielectric structures 6200 within a given SIW 6300 has a central vertical axis 6208, 6210, parallel to a z-axis of the device 6100 (see FIG. 24A for example), that is sideways offset 6212 relative to each other within the confines of the corresponding SIW 6300 as observed in a plan view of the device 6100 (see FIG. 24C for example).

Aspect-13: The device 6100 of Aspect-12, wherein: the central vertical axes 6208, 6210 of closest neighboring ones of the plurality of dielectric structures 6200 within a given SIW 6300 are disposed a distance from each other by a distance of $\lambda/2$.

Figure 25:
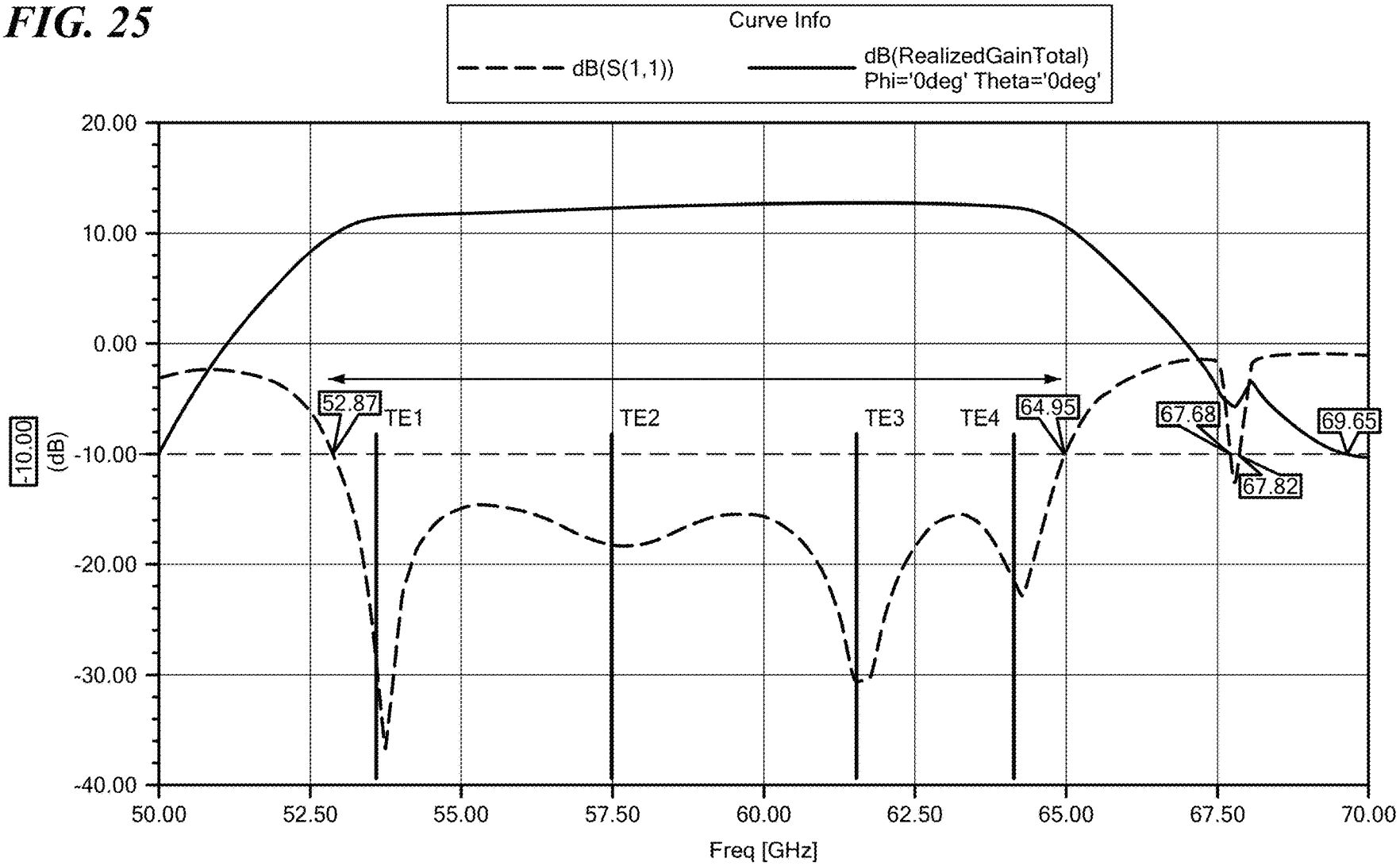
FIGS. 25, 26, 27, and 28, depict analytical modeling data associated with the embodiment of FIGS. 24A, 24B, and 24C, in accordance with an embodiment.

Aspect-14: The device 6100 of Aspect-8, wherein: in response to electrical excitation at the signal feed 6322 at a frequency of between about 52.5 GHz and about 65 GHz, the device 6100 is operable to radiate an electromagnetic radiation field having at least four transverse electric, TE, modes of radiation, as observed from the analytical modeling data depicted in FIG. 25. An advantage of being able to radiate at least four TE modes of radiation, using tall (high aspect ratio) SDPs 6252 as disclosed herein, is enhanced bandwidth with a flat gain over the bandwidth, also as observed in the analytical modeling data depicted in FIG. 25, which shows a gain of 10-12 dBi over a bandwidth of 20%. While FIG. 25 depicts only four TE modes of radiation (TE1, TE2, TE3, TE4), it is contemplated that a greater number of TE modes of radiation may be possible by applying the teachings of the disclosure herein, thereby further improving gain, bandwidth, or both.

Figure 26:
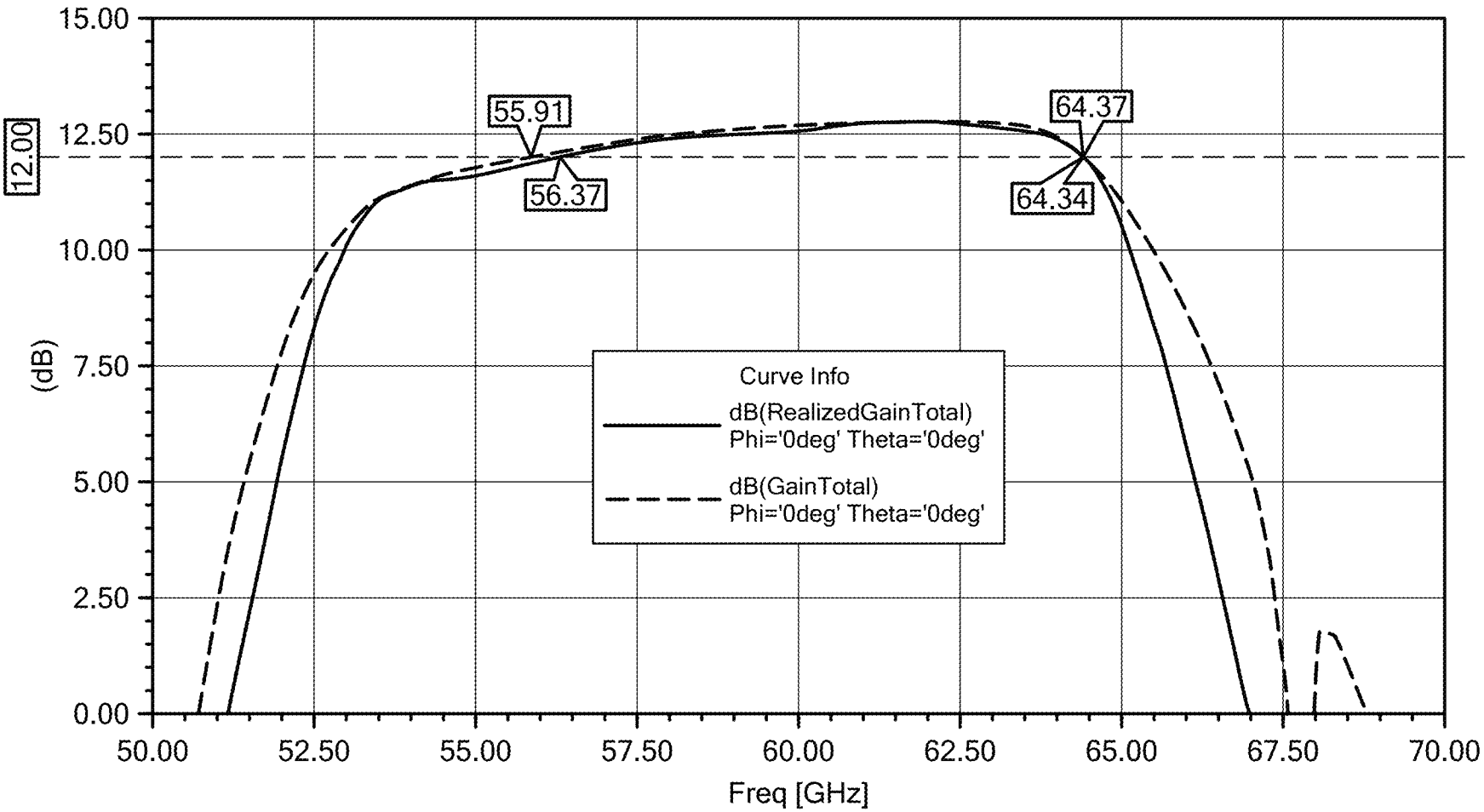
Figure 27:
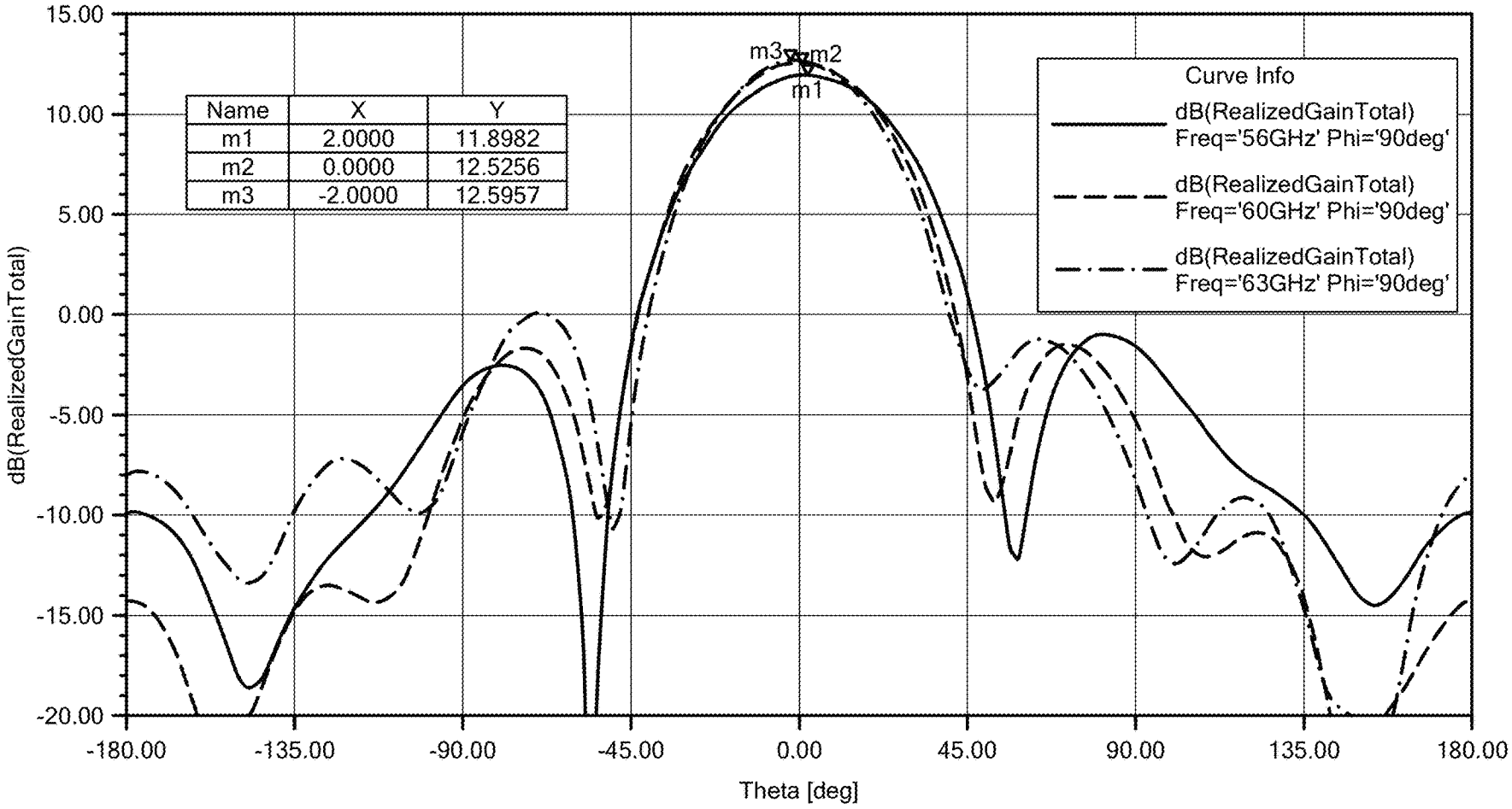
Figure 28:
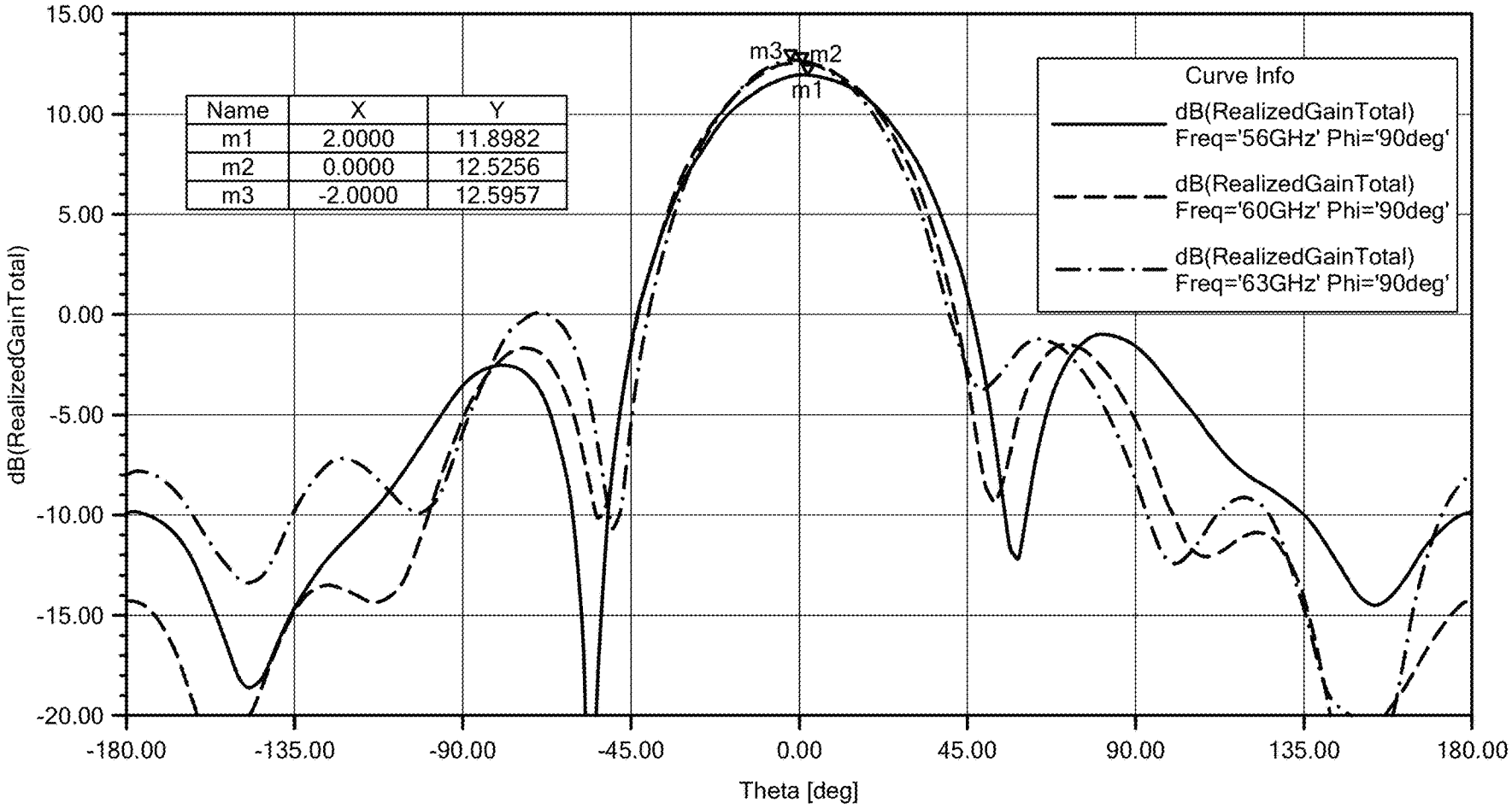

Aspect-15: The device 6100 of Aspect-14, wherein: the device 6100 is operable with a gain of at least 10 dBi over the four TE modes of radiation (see FIG. 25 for example). FIGS. 26, 27, and 28, provide additional analytical modeling data for the device 6100. For example: FIG. 26 shows a gain in excess of 12 dBi with a bandwidth of about 13.3%; FIG. 27 shows a beam squint of +/−2 degrees with only a 0.6 dBi gain drop at Phi=0 degrees; and, FIG. 28 shows a beam squint of +/−2 degrees with only a 0.6 dBi gain drop at Phi=90 degrees.

Aspect-16 (see FIGS. 29A, 29B and 29C, with reference to FIGS. 24A, 24B, and 24C, for example): An electromagnetic array 6500 comprising a plurality of the device 6100 of Aspect-8 integrally arranged side by side each other wherein each lower conductive layer 602 is continuous, each upper conductive layer 6304 is continuous, each dielectric layer 6306 is continuous, and a combination of each EMR structure 6400 of each device 6100 forms an aggregate EMR structure 6420, wherein: the aggregate EMR structure 6420 has a first portion 6422 that includes the plurality of electromagnetic reflectors 6410, and a second portion 6424 that includes a plurality of electromagnetic reflective, EMR, extensions 6426, each signal feed 6322 being flanked on each side by one of the plurality of EMR extensions 6426 that serves to improve signal isolation between adjacent ones of the signal feeds 6322.

Aspect-17: The array 6500 of Aspect-16, wherein: the central vertical axes 6208, 6210 of closest neighboring ones of the plurality of dielectric structures 6200 within a given SIW 6300 are disposed a distance 6212 from each other by a distance of $\lambda/2$.

Aspect-18 (with specific reference now to FIG. 30C and general reference to FIGS. 30A and 30B in combination with FIGS. 29A, 29B, and 29C): The array 6500 of Aspect-17, wherein: the central vertical axes 6214, 6216 of closest neighboring ones of the plurality of dielectric structures 6200 in neighboring SIWs 6300.1, 6300.2 are disposed a distance 6218 from each other by a distance of $\lambda/4$.

Aspect-19: The device 6100 of Aspect-6, wherein: the FDP 6202 has a first dielectric constant value, Dk1; the SDP 6252 has a second dielectric constant value, Dk2; the dielectric layer 6306 of the SIW 6300 has a third dielectric constant value, Dk3; Dk2 is less than Dk1, and Dk3 less than Dk1.

Aspect-20: The device 6100 of Aspect-19, wherein: Dk3 is equal to or greater than Dk2.

Aspect-21: The device 6100 of Aspect-19, wherein: Dk3 is equal to or less than 0.5 times Dk1.

Aspect-22 (see FIG. 31 in combination with FIGS. 29A, 29B, 29C, 30A, 30B, and 30C, for example): An electromagnetic device 6600, comprising: a first electromagnetic, EM, signal feed 6322.1; a second EM signal feed 6322.2 disposed adjacent to the first EM signal feed 6322.1; and, an elevated electrically conductive region 6426 disposed between and elevated relative to the first and second EM signal feeds 6322.1, 6322.2.

Aspect-23: The device 6600 of Aspect-22, wherein: the first and second EM signal feeds 6322.1, 6322.2 are disposed on a feed substrate 6300; the elevated electrically conductive region 6426 comprises a metal-plated substrate having a first elongated cavity 6602 disposed over the first EM signal feed 6322.1, and a second elongated cavity 6604 disposed over the second EM signal feed 6322.2, and an elongated electrically conductive finger 6426 that forms the elevated electrically conductive region disposed between the first and second EM signal feeds 6322.1, 6322.2.

Aspect-24: The device 6600 of Aspect-23, wherein: the feed substrate 6300 comprises an upper electrically conductive layer 6304; and the elongated electrically conductive finger 6426 is electrically bonded to the upper electrically conductive layer 6304 of the feed substrate 6300.

Aspect-25: The device 6600 of Aspect-23, wherein: the feed substrate 6300 comprises a first portion 6320 having the first and second EM signal feeds 6322.1, 6322.2 arranged thereon, and a second portion 6330 that provides a support region (upper surface of the upper electrically conductive layer 6304) for a plurality of dielectric structures 6200 and is an extension of the first portion 6320; a first set 6200.1 of the plurality of dielectric structures is disposed to electromagnetically cooperate with the first EM signal feed 6322.1, and a second set 6200.2 of the plurality of dielectric structures is disposed to electromagnetically cooperate with the second EM signal feed 6322.2; and the first and second EM signal feeds 6322.1, 6322.2 are disposed on the first portion 6320 and not on the second portion 6330.

Aspect-26: The device 6600 of Aspect-25, wherein: the plurality of dielectric structures 6200 is disposed on the support region of the second portion 6330.

Aspect-27: The device 6600 of Aspect-26, wherein each dielectric structure of the plurality of dielectric structures 6200 comprises: a first dielectric portion, FDP, 6202 having a proximal end 6204 and a distal end 6206, the FDP 6202 comprising a dielectric material other than air; and a second dielectric portion, SDP, 6252 having a proximal end 6254 and a distal end 6256, the proximal end 6254 of the SDP 6252 being disposed proximate the distal end 6206 of the FDP 6202, the SDP 6252 comprising a dielectric material other than air; wherein the dielectric material of the FDP 6202 has an average dielectric constant that is greater than the average dielectric constant of the dielectric material of the SDP 6252.

Aspect-28: The device 6600 of Aspect-27, wherein: at least the FDP 6202 is a dielectric resonator structure.

Aspect-29: The device 6600 of Aspect-27, wherein: the distal end 6256 of each SDP 6252 has a relatively thin connecting structure 6280 that integrally interconnects a neighboring SDP 6252.1, 6252.2, wherein the relatively thin connecting structure 6280 has a thickness t that is relatively thin in relation to an overall width dimension W1, as observed in a side elevation view, of the proximal end 6254 of a given SDP 6252.

Aspect-30: The device 6600 of Aspect-27, wherein: the FDP 6202 has a first dielectric constant Dk1 that is equal to or greater than 10 and equal to or less than 20; and the SDP 6252 has a second dielectric constant Dk2 that is greater than the dielectric constant of air and equal to or less than 9.

Aspect-31: The device 6600 of Aspect-30, wherein: the SDP 6252 has an overall height dimension HS as observed in a side elevation view, and the proximal end 6254 of the SDP 6252 has an overall width dimension W1 as observed in a side elevation view; and HS is equal to or greater than 2.5 times W1, and is equal to or less than 55 times W1.

Aspect-32: The device 6600 of Aspect-30, further comprising: an electromagnetic reflective, EMR, structure 6400 having a plurality of electromagnetic reflectors 6410, each reflector of the plurality of electromagnetic reflectors 6410 disposed around and in one-to-one correspondence with a corresponding one of the plurality of dielectric structures 6200; the EMR structure 6400 disposed in electrical communication with the second portion 6330 of the feed substrate 6300; and the EMR structure 6400 disposed in electrical communication with the elevated electrically conductive region 6426 disposed between the first and second EM signal feeds 6322.1, 6322.2.

Aspect-33: The device 6600 of Aspect-24, wherein: each of the first and the second EM signal feeds 6322.1, 6322.2 are formed in the upper electrically conductive layer 6304 via an absence 6324.1 6324.2 of conductive material of the upper electrically conductive layer 6304.

Aspect-34: The device 6600 of Aspect-33, wherein the feed substrate is a substrate integrated waveguide, SIW, 6300 and further comprises: a lower electrically conductive layer 6302; a dielectric layer 6306 disposed between the lower and the upper electrically conductive layers 6302, 6304; a plurality of electrically conductive vias 6308 disposed between and in electrical communication with the lower and upper electrically conductive layers 6302, 6304, the plurality of electrically conductive vias 6308 arranged to form first and second electromagnetic, EM, waveguides

6310.1 and 6310.2 of the SIW 6300, which electromagnetically cooperate with the first and second EM signal feeds 6322.1, 6322.2, respectively; wherein a first portion 6320 of the SIW 6300 comprises a coplanar signal feed structure having the first and second EM signal feeds 6322.1, 6322.2; wherein a second portion 6330 of the SIW 6300 provides a support for a plurality of dielectric resonator structures 6200 (see FIGS. 24A, 29A, and 30A) and is an extension of the first portion 6320 of the SIW 6300; wherein a first set 6200.1 of the plurality of dielectric resonator structures 6200 is disposed to electromagnetically cooperate with the first EM waveguide 6310.1, and a second set 6200.2 of the plurality of dielectric resonator structures 6200 is disposed to electromagnetically cooperate with the second EM waveguide 6310.2; wherein the first and second EM signal feeds 6322.1, 6322.2 are disposed on the first portion 6320 and not on the second portion 6330.

Aspect-35: The device 6600 of Aspect-34, wherein: each of the first and second EM signal feeds 6322.1, 6322.2 has a signal input region 6326 and a signal output region 6328 (see FIG. 24C for example); the signal output region 6328 being disposed a distance d from the second portion 6330 (see FIG. 24C for example); and d is greater than zero and equal to or less than $\lambda/20$, where $\lambda$ is an operational wavelength at an operating frequency of the device.

Aspect-36 (best seen with reference to FIGS. 31 and 24C): The device 6600 of Aspect-35, further comprising: an electromagnetic reflective, EMR, structure 6400 having a plurality of electromagnetic reflectors 6410, each reflector of the plurality of electromagnetic reflectors 6410 disposed around and in one-to-one correspondence with a corresponding one of the plurality of dielectric resonator structures 6200; the EMR structure 6400 disposed in electrical communication with the upper conductive layer 6304 on the second portion 6330 of the SIW 6300; the EMR structure 6400 disposed in electrical communication with the elevated electrically conductive region 6426 disposed between the first and second EM signal feeds 6322.1, 6322.2.

Aspect-37: The device 6600 of Aspect-36, wherein: each of the first and second EM signal feeds 6322.1, 6322.2 of the coplanar signal feed structure has a signal input impedance of about 50 ohm, and a signal output impedance of greater than 50 ohm.

Aspect-38: The device 6600 of Aspect-36, wherein: the plurality of electrically conductive vias 6308 of a corresponding one of the first and second EM waveguides 6310.1, 6310.2 are disposed on each side of and are proximate the corresponding EM signal feed 6322.1, 6322.2, and are arranged relative to each other so as to form a wall of overlapping vias 6312 (best seen with reference to FIG. 24B) as observed in a side view of the SIW 6300 to reduce sideways signal leakage from the corresponding EM signal feed 6322.1, 6322.2.

Aspect-39: The device 6600 of Aspect-34, wherein each dielectric resonator structure of the plurality of dielectric resonator structures 6200 comprises: a first dielectric portion, FDP, 6202 having a proximal end 6204 and a distal end 6206, the FDP 6202 comprising a dielectric material other than air; and a second dielectric portion, SDP, 6252 having a proximal end 6254 and a distal end 6256, the proximal end 6254 of the SDP 6252 being disposed proximate the distal end 6206 of the FDP 6202, the SDP 6252 comprising a dielectric material other than air; wherein the dielectric material of the FDP 6202 has an average dielectric constant that is greater than the average dielectric constant of the dielectric material of the SDP 6252.

Aspect-40: The device 6600 of Aspect-39, wherein: the FDP 6202 has a first dielectric constant Dk1 that is equal to or greater than 10 and equal to or less than 20; and the SDP 6252 has a second dielectric constant Dk2 that is greater than the dielectric constant of air and equal to or less than 9.

Aspect-41: The device 6600 of Aspect-40, wherein: the SDP 6252 has an overall height dimension HS as observed in a side elevation view, and the proximal end 6254 of the SDP 6252 has an overall width dimension W1 as observed in a side elevation view; and HS is equal to or greater than 2.5 times W1, and is equal to or less than 55 times W1.

Figure 24A:
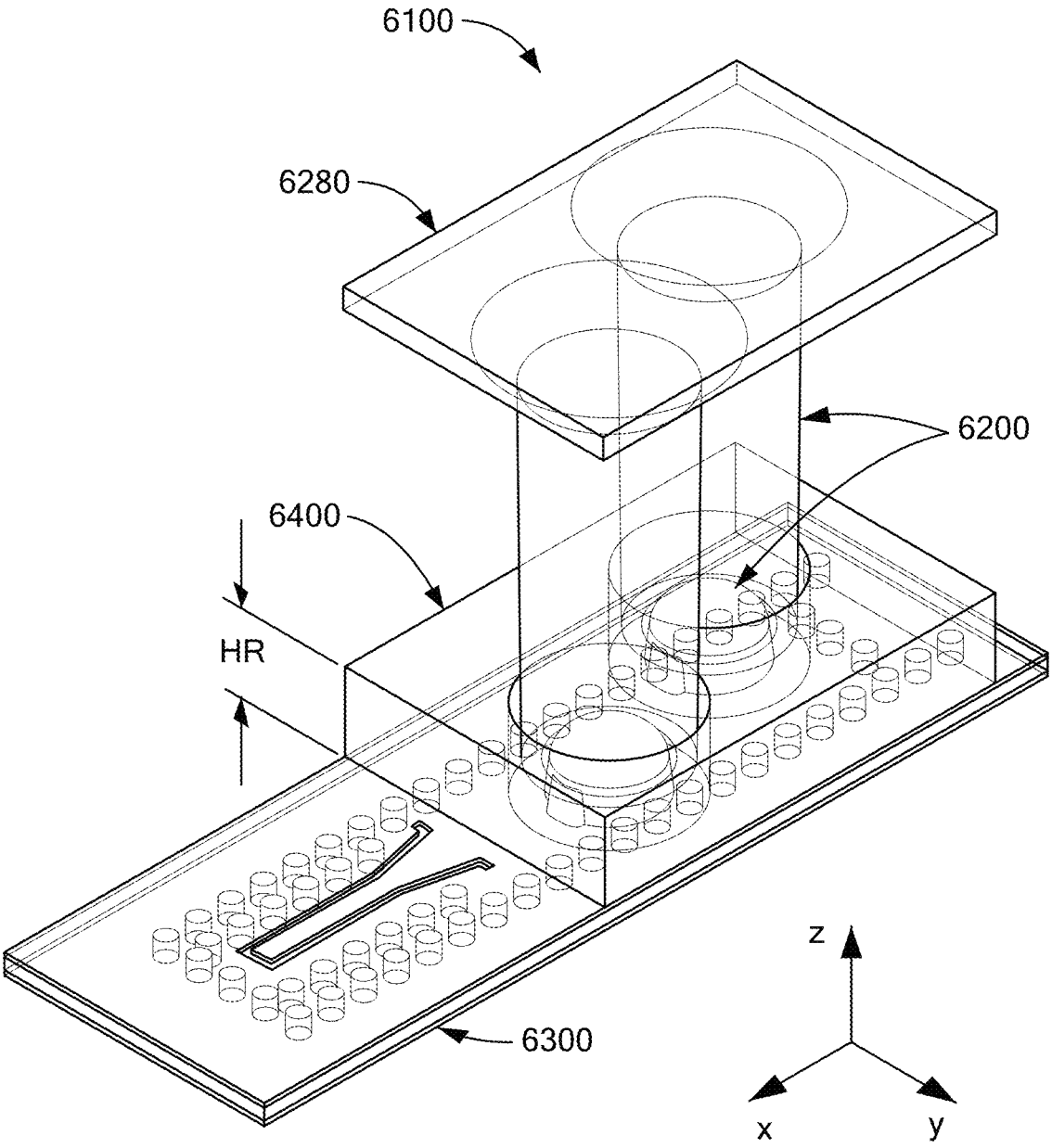
FIGS. 24A, 24B, and 24C, depict, respectively, a transparent rotated perspective view, a transparent side elevation view, and a transparent top down plan view, of an EM device, in accordance with an embodiment.
Figure 24B:
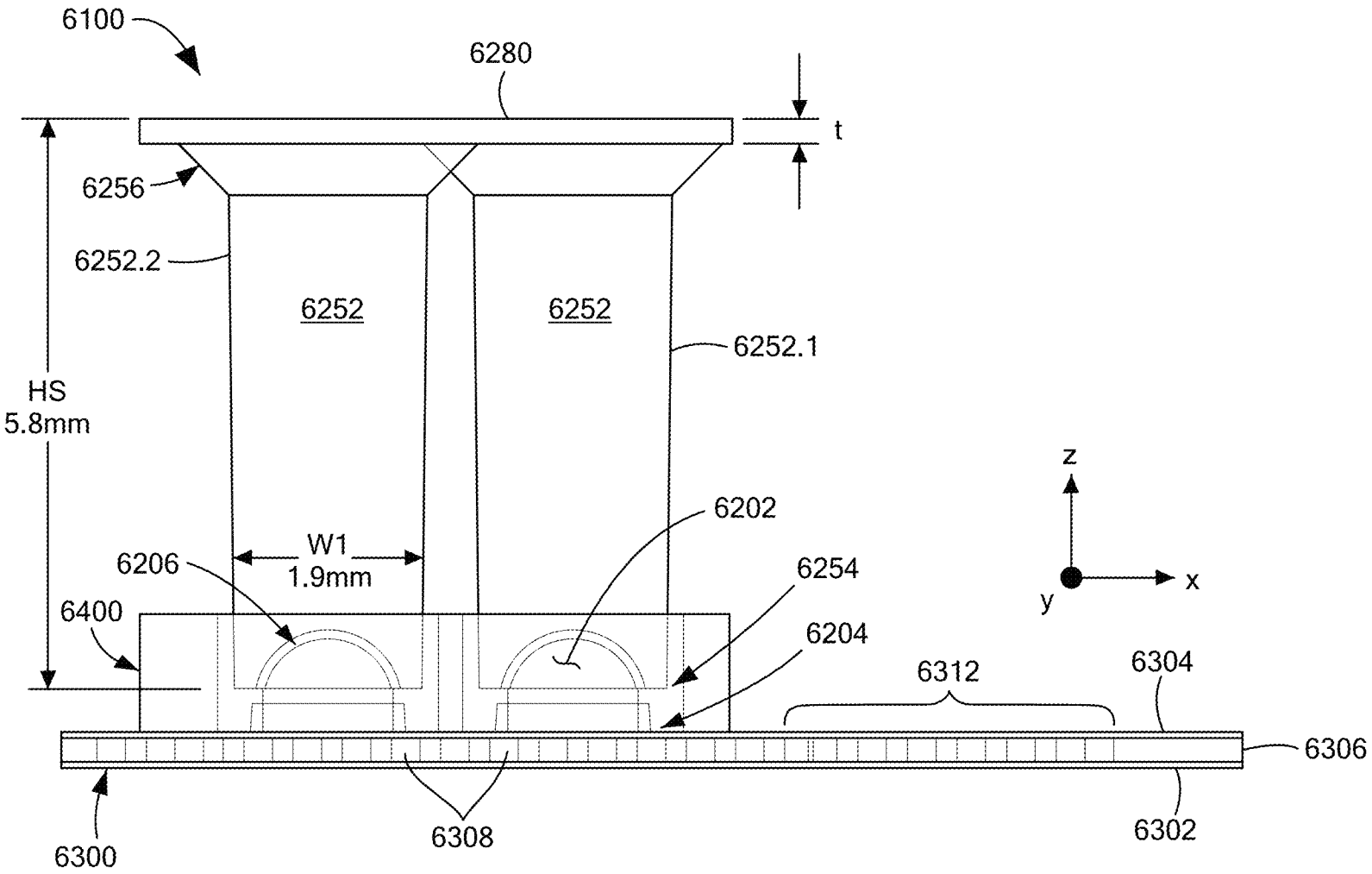
Figure 24C:
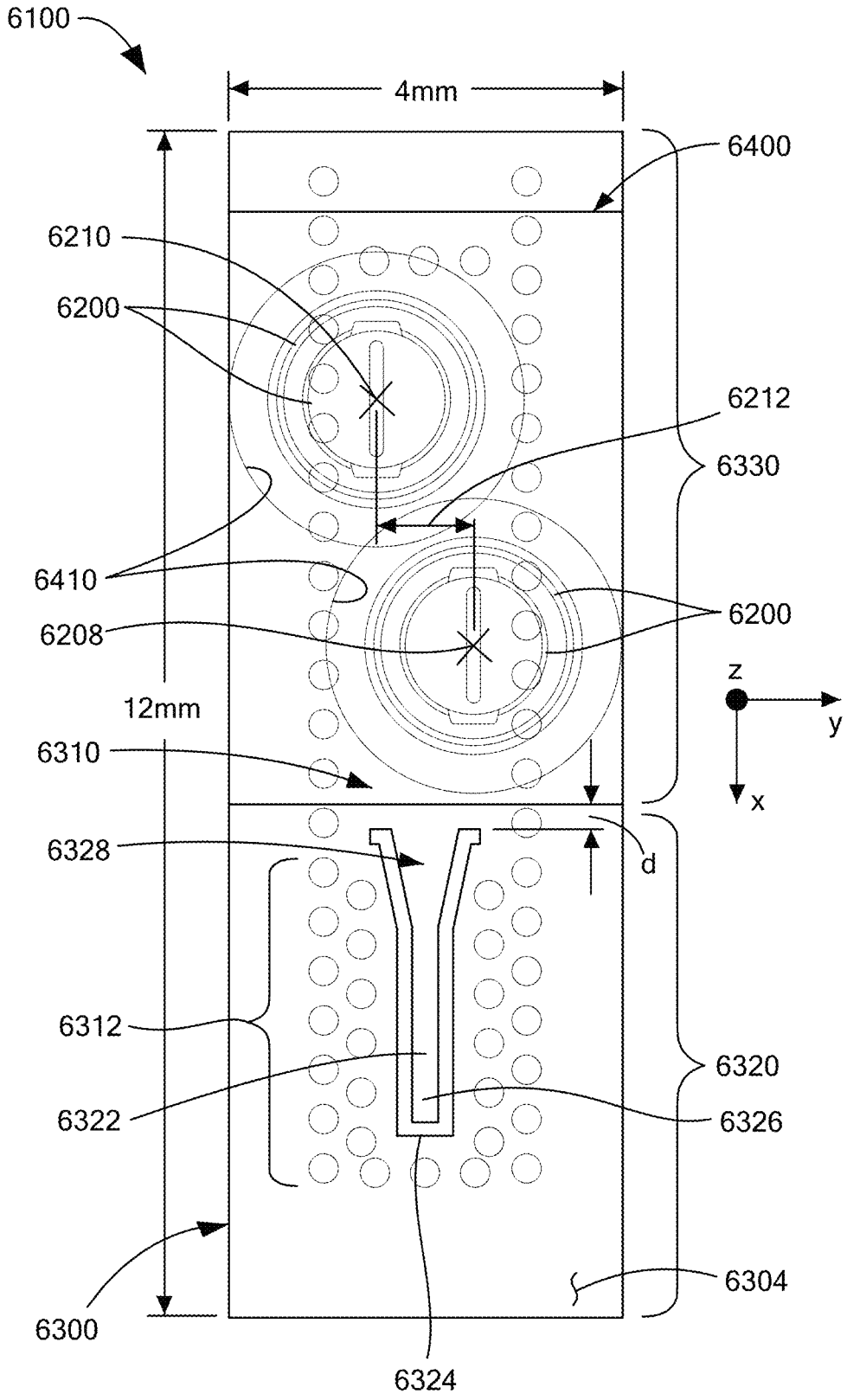
Figure 29A:
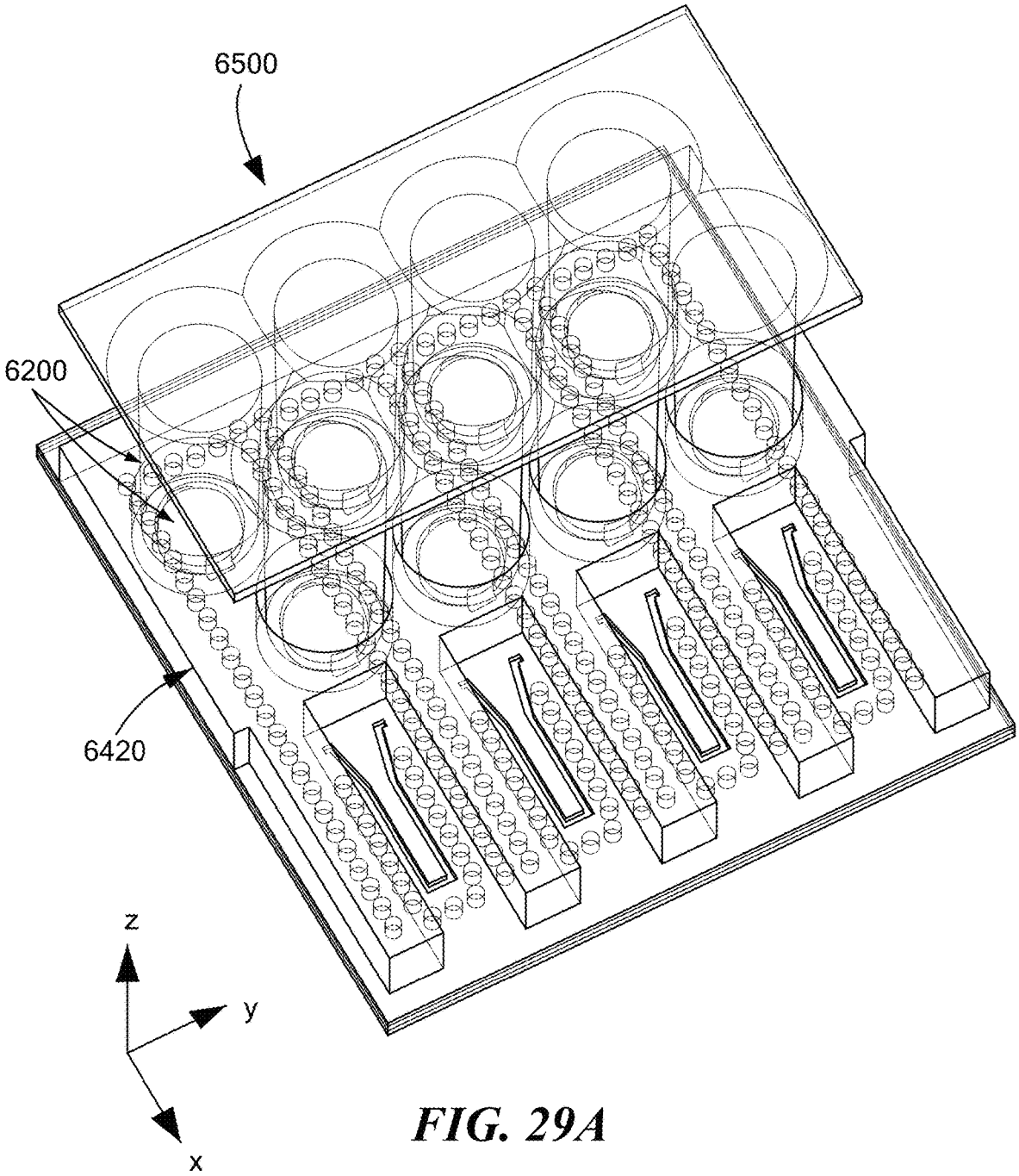
FIGS. 29A, 29B, and 29C, depict, respectively, a transparent rotated perspective view, a transparent side elevation view, and a transparent top down plan view, of an array of the EM device of FIGS. 24A, 24B, and 24C, with additional signal isolation features incorporated, in accordance with an embodiment.
Figure 29B:
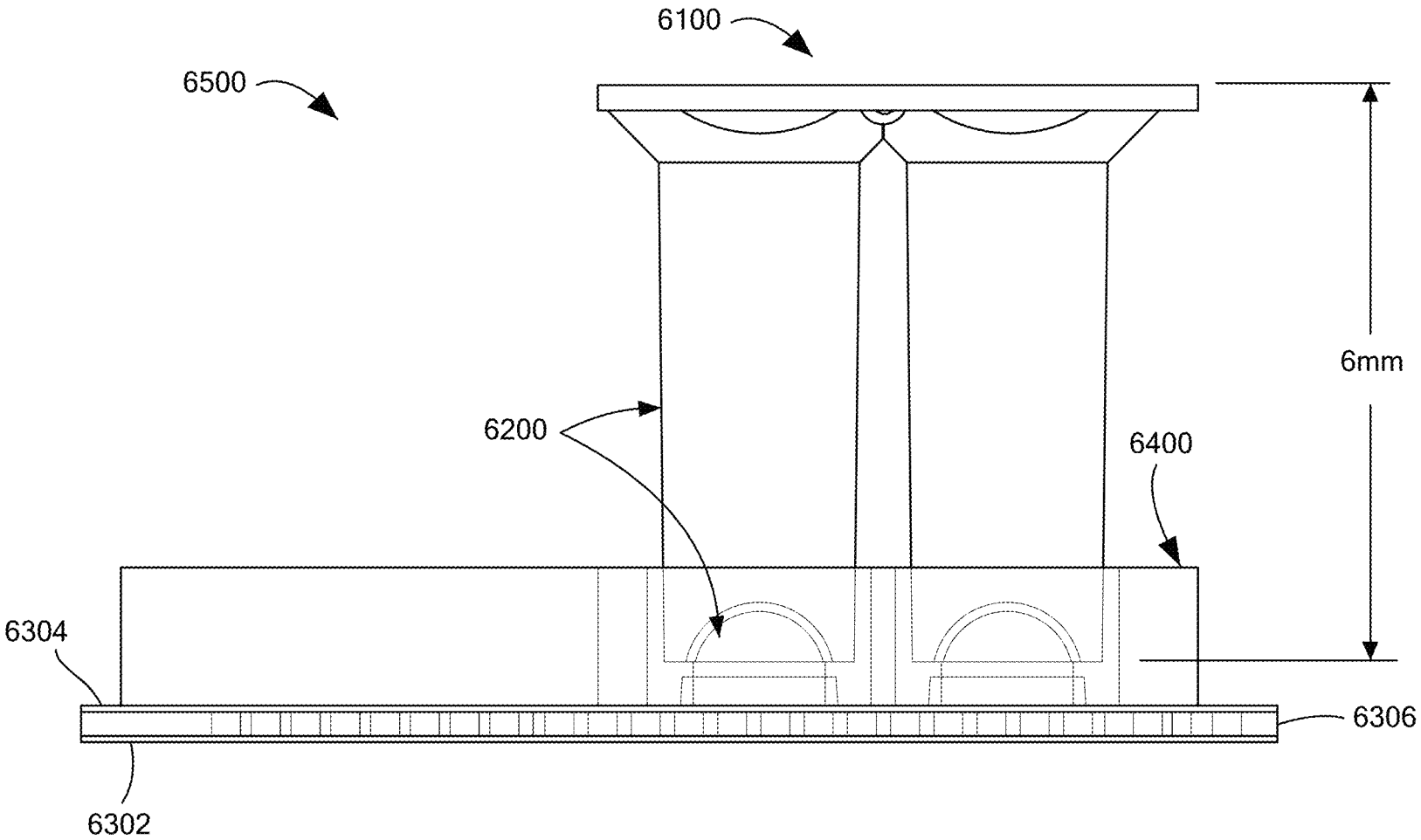
Figure 29C:
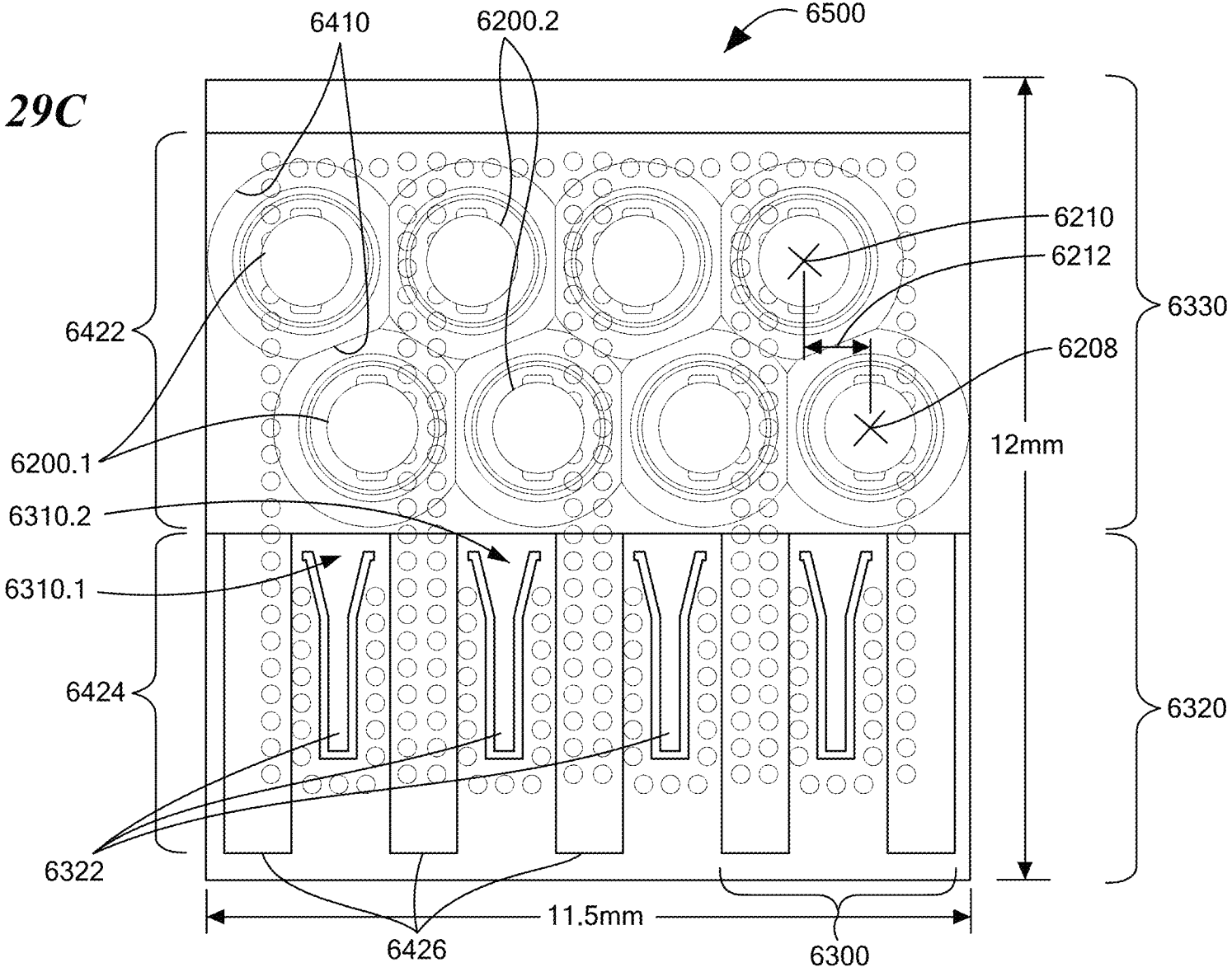
Figure 30A:
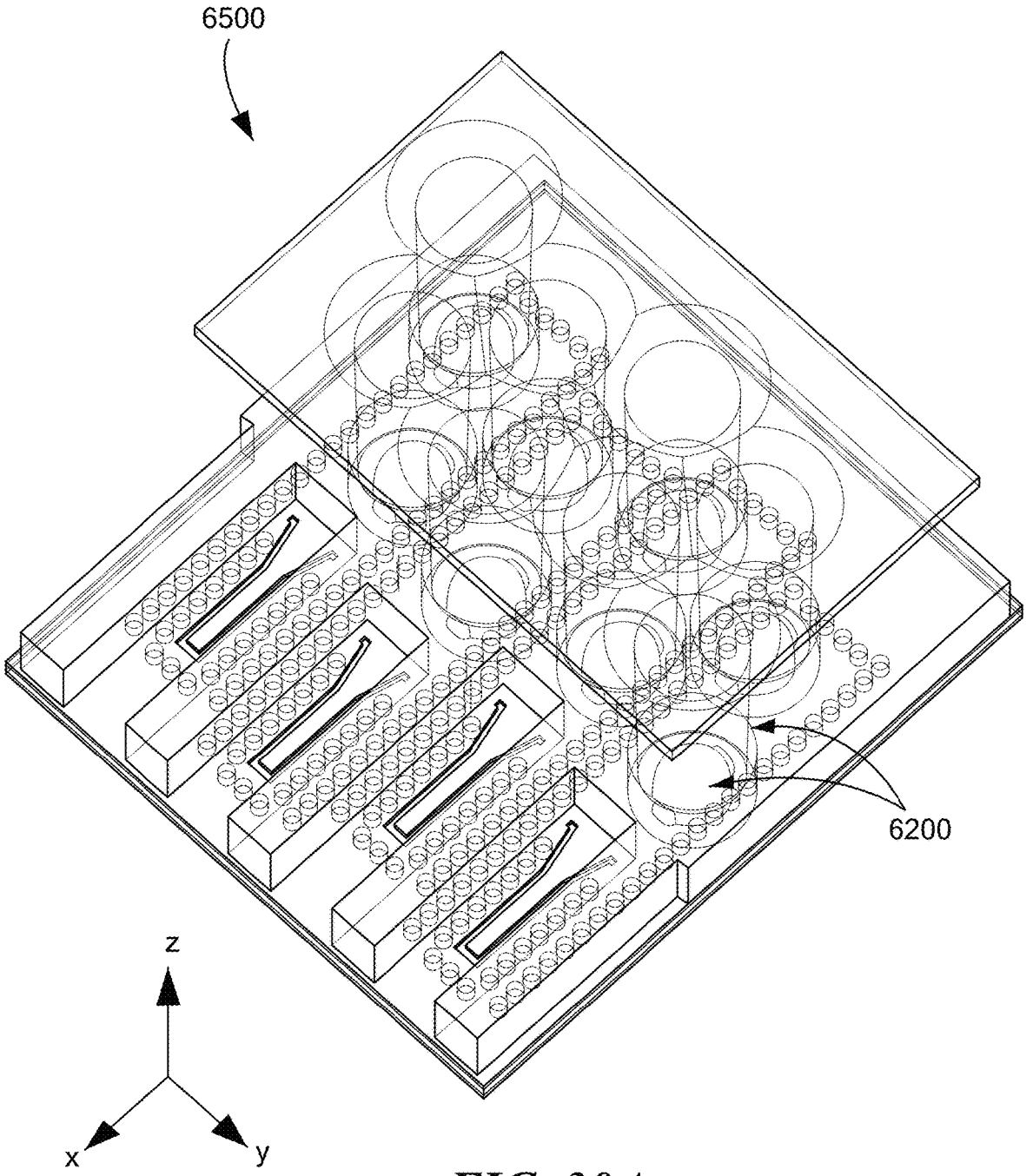
FIGS. 30A, 30B, and 30C, depict, respectively, a transparent rotated perspective view, a transparent side elevation view, and a transparent top down plan view, of an alternative array to that of FIGS. 29A, 29B, and 29C, in accordance with an embodiment.
Figure 30B:
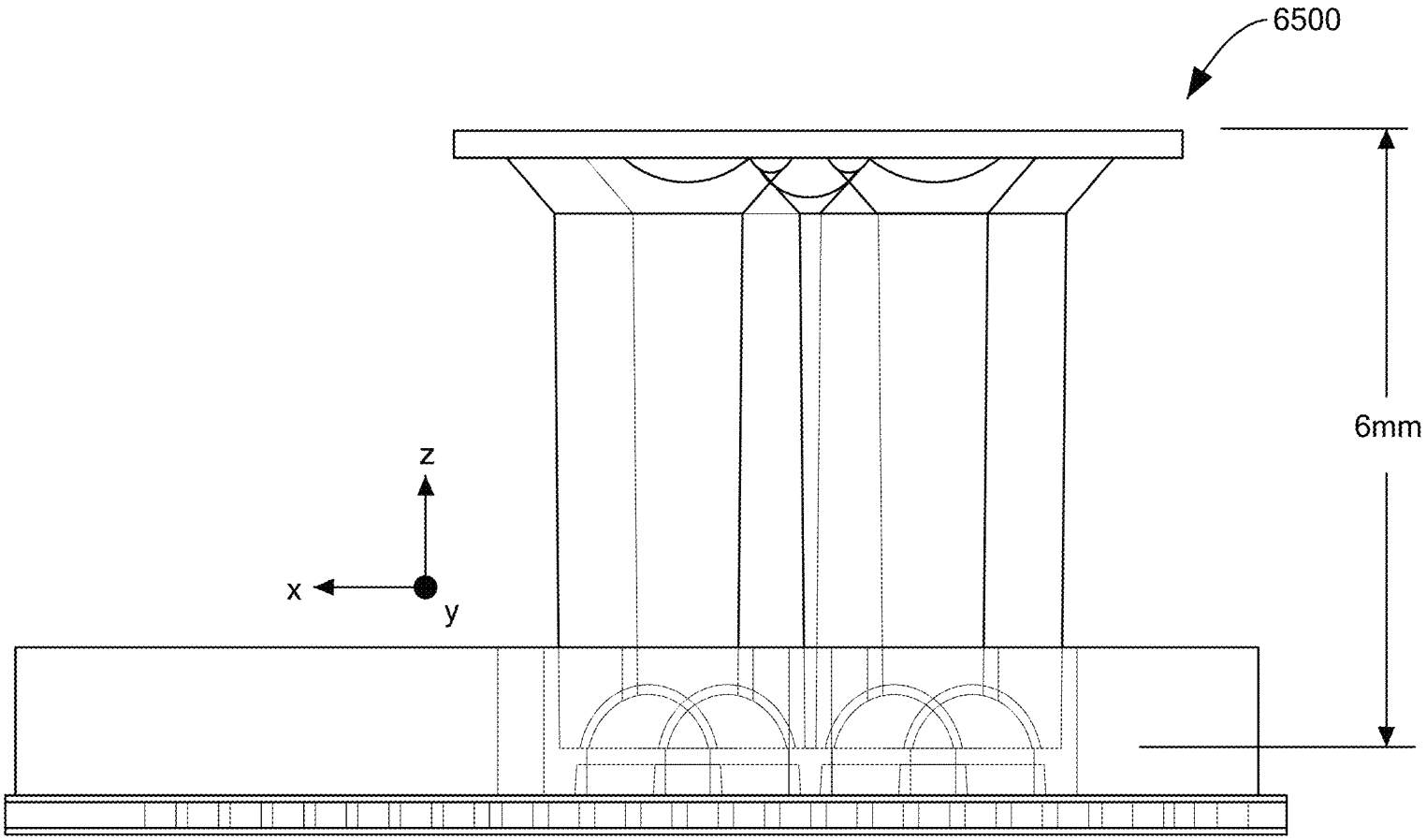
Figure 31:
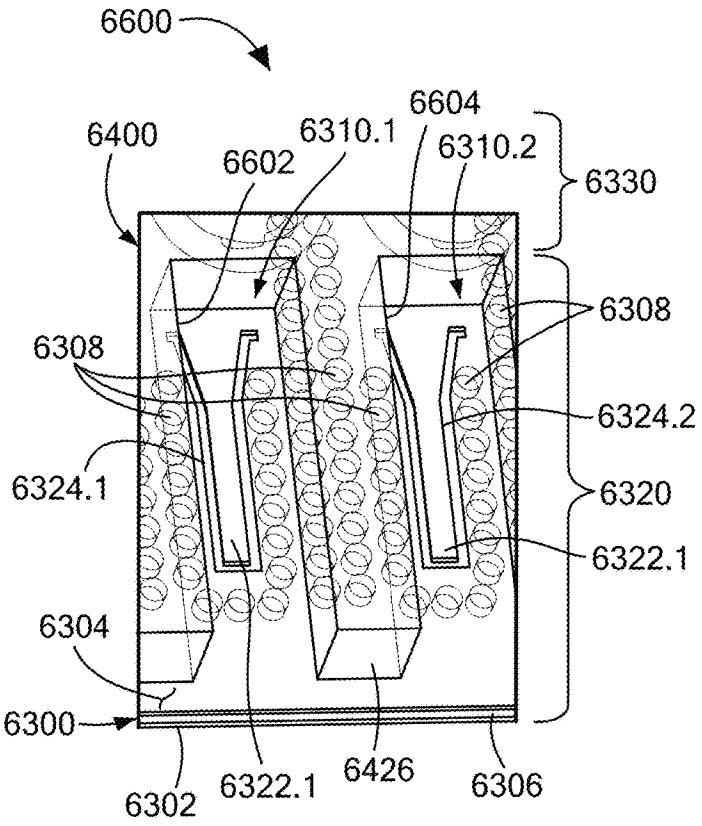
FIG. 31 depicts a transparent rotated perspective view of an EM device that is a portion of the array depicted in FIGS. 29A, 29B, and 29C, or of the array depicted in FIGS. 30A, 30B, and 30C, in accordance with an embodiment.
Figure 30C:
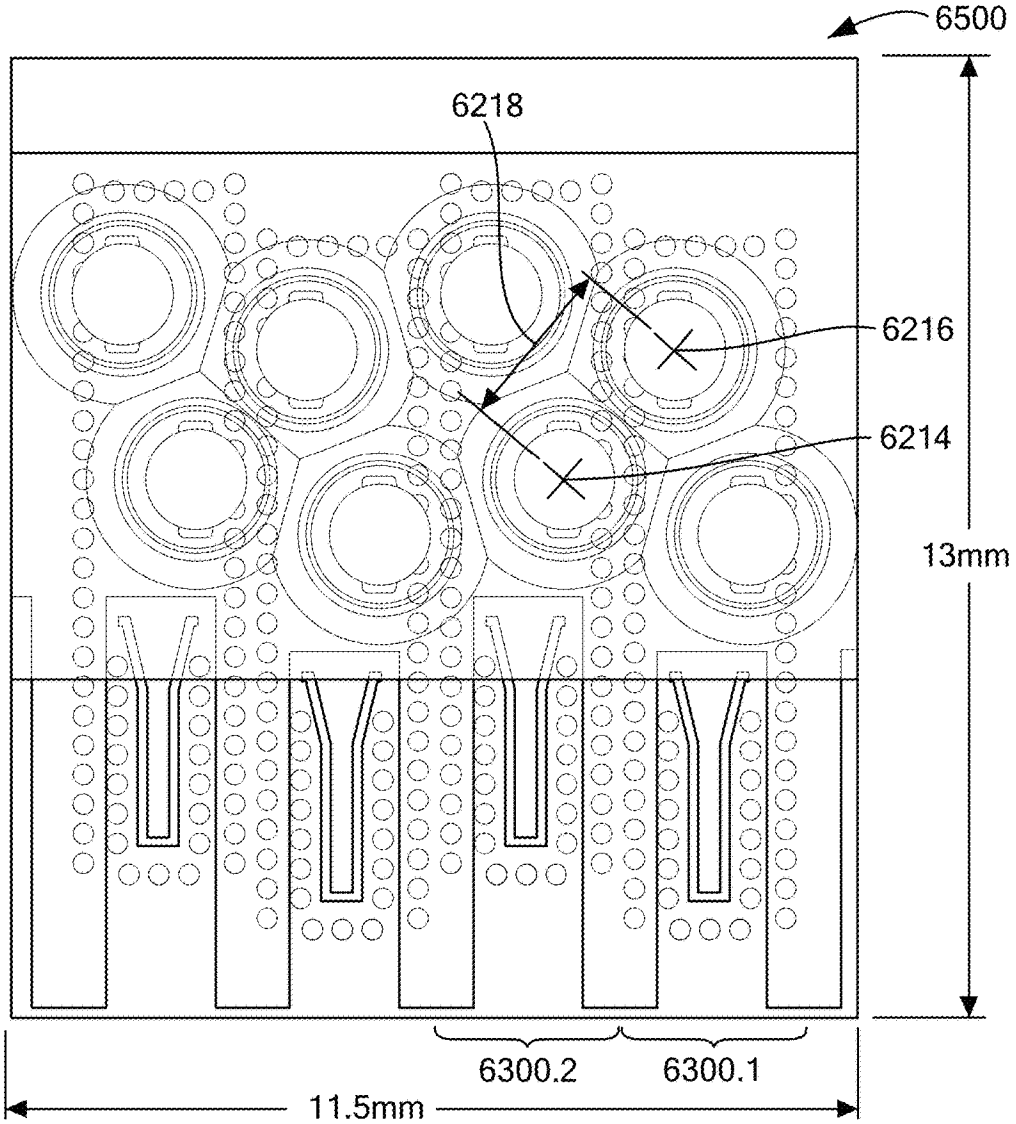

As used herein with respect to the foregoing Aspects 1-41, reference to the term elevated, means elevated in a positive z-direction along the z-axis of the x-y-z orthogonal coordinate system as depicted in FIGS. 24A, 29A, and 30A.

In view of all of the foregoing, while certain combinations of EM device features have been described herein, it will be appreciated that these certain combinations are for illustration purposes only and that any combination of any of the EM device features disclosed herein may be employed in accordance with an embodiment of the invention. Any and all such combinations are contemplated herein and are considered to fall within the ambit of an invention disclosed herein.

While an invention has been described herein with reference to example embodiments, it will be understood by those skilled in the art that various changes may be made and equivalents may be substituted for elements thereof without departing from the scope of the claims. Many modifications may be made to adapt a particular situation or material to the teachings of the invention without departing from the essential scope thereof. Therefore, it is intended that the invention not be limited to the particular embodiment or embodiments disclosed herein as the best or only mode contemplated for carrying out this invention, but that the invention will include all embodiments falling within the scope of the appended claims. In the drawings and the description, there have been disclosed example embodiments and, although specific terms and/or dimensions may have been employed, they are unless otherwise stated used in a generic, exemplary and/or descriptive sense only and not for purposes of limitation, the scope of the claims therefore not being so limited. When an element such as a layer, film, region, substrate, or other described feature is referred to as being "on" another element, it can be directly on the other element, or intervening elements may also be present. In contrast, when an element is referred to as being "directly on" another element, there are no intervening elements present. The use of the terms first, second, etc. do not denote any order or importance, but rather the terms first, second, etc. are used to distinguish one element from another. The use of the terms a, an, etc. do not denote a limitation of quantity, but rather denote the presence of at least one of the referenced item. The term "comprising" as used herein does not exclude the possible inclusion of one or more additional features. And, any background information provided herein is provided to reveal information believed by the applicant to be of possible relevance to the invention disclosed herein. No admission is necessarily intended, nor should be construed, that any of such background information constitutes prior art against an embodiment of the invention disclosed herein.

The invention claimed is:

1. An electromagnetic device, comprising:

a first electrically conductive electromagnetic, EM, signal feed formed on a feed substrate;

a second electrically conductive EM signal feed disposed adjacent to the first EM signal feed formed on the feed substrate; and an elevated electrically conductive region formed by an electrically conductive substrate electrically bonded to the feed substrate, the elevated electrically conductive region being disposed between and elevated relative to the first and second electrically conductive EM signal feeds.

2. The device of claim 1, wherein:

the electrically conductive substrate further comprises a first elongated cavity disposed over the first electrically conductive EM signal feed, and a second elongated cavity disposed over the second electrically conductive EM signal feed, and an elongated electrically conductive finger that forms the elevated electrically conductive region disposed between the first and second electrically conductive EM signal feeds.

3. The device of claim 2, wherein:

the feed substrate comprises an upper electrically conductive layer; and the elongated electrically conductive finger is electrically connected to the upper electrically conductive layer of the feed substrate.

4. The device of claim 2, wherein:

the feed substrate comprises a first portion having the first and second EM signal feeds arranged thereon, and a second portion that provides a support region for a plurality of dielectric structures and is an extension of the first portion;

a first set of the plurality of dielectric structures is disposed to electromagnetically cooperate with the first EM signal feed, and a second set of the plurality of dielectric structures is disposed to electromagnetically cooperate with the second EM signal feed; and the first and second EM signal feeds are disposed on the first portion and not on the second portion.

5. The device of claim 4, wherein:

the plurality of dielectric structures is disposed on the support region of the second portion.

6. The device of claim 5, wherein each dielectric structure of the plurality of dielectric structures comprises:

a first dielectric portion, FDP, having a proximal end and a distal end, the FDP comprising a dielectric material other than air; and a second dielectric portion, SDP, having a proximal end and a distal end, the proximal end of the SDP being disposed proximate the distal end of the FDP, the SDP comprising a dielectric material other than air;

wherein the dielectric material of the FDP has an average dielectric constant that is greater than the average dielectric constant of the dielectric material of the SDP.

7. The device of claim 6, wherein:

at least the FDP is a dielectric resonator structure.

8. The device of claim 6, wherein:

the distal end of each SDP has a relatively thin connecting structure that integrally interconnects a neighboring SDP, wherein the relatively thin connecting structure has a thickness t that is relatively thin in relation to an overall width dimension W1, as observed in a side elevation view, of the proximal end of a given SDP.

9. The device of claim 6, wherein:

the FDP has a first dielectric constant Dk1 that is equal to or greater than 10 and equal to or less than 20; and the SDP has a second dielectric constant Dk2 that is greater than the dielectric constant of air and equal to or less than 9.

10. The device of claim 9, wherein:

the SDP has an overall height dimension HS as observed in a side elevation view, and the proximal end of the SDP has an overall width dimension W1 as observed in a side elevation view; and HS is equal to or greater than 2.5 times W1, and is equal to or less than 55 times W1.

11. The device of claim 9, further comprising:

an electromagnetic reflective, EMR, structure having a plurality of electromagnetic reflectors, each reflector of the plurality of electromagnetic reflectors disposed around and in one-to-one correspondence with a corresponding one of the plurality of dielectric structures;

the EMR structure disposed in electrical communication with the second portion of the feed substrate; and the EMR structure disposed in electrical communication with the elevated electrically conductive region disposed between the first and second EM signal feeds.

12. The device of claim 3, wherein:

each of the first and the second EM signal feeds are formed in the upper electrically conductive layer via an absence of conductive material of the upper electrically conductive layer.

13. The device of claim 12, wherein the feed substrate is a substrate integrated waveguide, SIW, and further comprises:

a lower electrically conductive layer;

a dielectric layer disposed between the lower and the upper electrically conductive layers;

a plurality of electrically conductive vias disposed between and in electrical communication with the lower and upper electrically conductive layers, the plurality of electrically conductive vias arranged to form first and second electromagnetic, EM, waveguides of the SIW, which electromagnetically cooperate with the first and second EM signal feeds, respectively;

wherein a first portion of the SIW comprises a coplanar signal feed structure having the first and second EM signal feeds;

wherein a second portion of the SIW provides a support for a plurality of dielectric resonator structures and is an extension of the first portion of the SIW;

wherein a first set of the plurality of dielectric resonator structures is disposed to electromagnetically cooperate with the first EM waveguide, and a second set of the plurality of dielectric resonator structures is disposed to electromagnetically cooperate with the second EM waveguide;

wherein the first and second EM signal feeds are disposed on the first portion and not on the second portion.

14. The device of claim 13, wherein:

each of the first and second EM signal feeds has a signal input region and a signal output region;

the signal output region being disposed a distance d from the second portion; and d is greater than zero and equal to or less than $\lambda/20$, where $\lambda$, is an operational wavelength at an operating frequency of the device.

15. The device of claim 14, further comprising:

an electromagnetic reflective, EMR, structure having a plurality of electromagnetic reflectors, each reflector of the plurality of electromagnetic reflectors disposed around and in one-to-one correspondence with a corresponding one of the plurality of dielectric resonator structures;

the EMR structure disposed in electrical communication with the upper conductive layer on the second portion of the SIW;

the EMR structure disposed in electrical communication with the elevated electrically conductive region disposed between the first and second EM signal feeds.

16. The device of claim 15, wherein:

each of the first and second EM signal feeds of the coplanar signal feed structure has a signal input impedance of about 50 ohm, and a signal output impedance of greater than 50 ohm.

17. The device of claim 15, wherein:

the plurality of electrically conductive vias of a corresponding one of the first and second EM waveguides are disposed on each side of and are proximate the corresponding EM signal feed, and are arranged relative to each other so as to form a wall of overlapping vias as observed in a side view of the SIW to reduce sideways signal leakage from the corresponding EM signal feed.

18. The device of claim 13, wherein each dielectric resonator structure of the plurality of dielectric resonator structures comprises:

a first dielectric portion, FDP, having a proximal end and a distal end, the FDP comprising a dielectric material other than air; and a second dielectric portion, SDP, having a proximal end and a distal end, the proximal end of the SDP being disposed proximate the distal end of the FDP, the SDP comprising a dielectric material other than air;

wherein the dielectric material of the FDP has an average dielectric constant that is greater than the average dielectric constant of the dielectric material of the SDP.

19. The device of claim 18, wherein: the FDP has a first dielectric constant Dk1 that is equal to or greater than 10 and equal to or less than 20; and the SDP has a second dielectric constant Dk2 that is greater than the dielectric constant of air and equal to or less than 9.

20. The device of claim 19, wherein:

the SDP has an overall height dimension HS as observed in a side elevation view, and the proximal end of the SDP has an overall width dimension W1 as observed in a side elevation view; and HS is equal to or greater than 2.5 times W1, and is equal to or less than 55 times W1.

21. The electromagnetic device of claim 1, wherein:

the first electrically conductive electromagnetic, EM, signal feed is formed in an upper electrically conductive layer of a metal-plated substrate via an absence of conductive material of the upper electrically conductive layer;

the second electrically conductive EM signal feed disposed adjacent to the first EM signal feed is formed in the upper electrically conductive layer of the metal-plated substrate via an absence of conductive material of the upper electrically conductive layer; and the electrically conductive region is formed by the electrically conductive substrate that also comprises a first elongated cavity disposed over the first electrically conductive EM signal feed, and a second elongated cavity disposed over the second electrically conductive EM signal feed.

* * * * *